US005377972A

United States Patent [19]

Sugishima et al.

[11] Patent Number: 5,377,972

[45] Date of Patent: Jan. 3, 1995

[54] SORTER

[75] Inventors: Yoshio Sugishima; Youichirou Irie; Tooru Himegi; Hiroyuki Nagai; Nobukazu Ootsuka; Takatoshi Nishimura, all of Osaka; Kenichi Honda, Kawasaki; Shouichirou Tajima, Sagamihara; Keiichi Asano, Nerima; Hiroyuki Kawaguchi; Shigeki Tamura, both of Kawasaki; Motohisa Washitani, Kaisou, all of Japan

[73] Assignee: Mita Industrial Co., Ltd., Osaka, Japan

[21] Appl. No.: 28,032

[22] Filed: Mar. 8, 1993

[30] Foreign Application Priority Data

| | | | |
|---|---|---|---|
| Mar. 12, 1992 | [JP] | Japan | 4-053830 |
| Mar. 12, 1992 | [JP] | Japan | 4-053833 |
| Mar. 12, 1992 | [JP] | Japan | 4-053873 |
| Mar. 12, 1992 | [JP] | Japan | 4-053874 |

[51] Int. Cl.[6] ..... B65H 31/24

[52] U.S. Cl. ..... 271/293; 271/294

[58] Field of Search ..... 271/293, 294; 270/53

[56] References Cited

U.S. PATENT DOCUMENTS

| | | | |
|---|---|---|---|
| 3,868,019 | 2/1975 | Stemmle . | |
| 4,083,550 | 4/1978 | Pal | 270/53 |
| 4,449,812 | 5/1984 | Furuichi | 271/294 X |
| 4,603,850 | 8/1986 | Horiuchi | 271/294 X |
| 4,941,657 | 7/1990 | Kitajima | 271/294 X |
| 4,962,920 | 10/1990 | Kitajima | 271/294 X |
| 5,180,152 | 1/1993 | Irie | 271/293 |
| 5,217,215 | 6/1993 | Ohata | 271/294 X |
| 5,236,185 | 8/1993 | Tuneda | 270/53 |

FOREIGN PATENT DOCUMENTS

| | | |
|---|---|---|
| 0523707 | 1/1993 | European Pat. Off. . |
| 0523710 | 1/1993 | European Pat. Off. . |

OTHER PUBLICATIONS

Patent Abstracts of Japan, vol. 14, No. 393 (M-1015), 24 Aug. 1990 & JP-A-02 147 564 (Toshiba Corp.) 6 Jun. 1990.

Patent Abstracts of Japan, vol. 14, No. 517 (M-1047), 13 Nov. 1990 & JP-A-02 215 653 (Canon Inc.) 28 Aug. 1990.

Patent Abstracts of Japan, vol. 13, No. 497 (M-889), 9 Nov. 1989 & JP-A-01 197 281 (Canon Inc.) 8 Aug. 1989.

Patent Abstracts of Japan, vol. 13, No. 565 (M-907) 14 Dec. 1989 & JP-A-01 236 168 (Mita Ind. Co.) 21 Sep. 1989.

*Primary Examiner*—Richard A. Schacher

*Attorney, Agent, or Firm*—Jordan and Hamburg

[57] ABSTRACT

A sorter for sorting sheets out is provided with a bin unit including a plurality of bins having specified length and width and a bin shifting mechanism for shifting the bin unit upward and downward. The respect ire bins are vertically spaced apart and adapted for placing the sorted sheets thereon. The sorter is further provided with a first detector for detecting that the bin unit has been moved down to a home position region defined in a lower portion of the sorter, and a shift controller for controlling the bin shifting mechanism. The shift controller shifts the bin unit downward until the first detector conducts the detection when the bin unit is not in the home position region when the power is applied the sorter. Accordingly, the home position of the bin unit can be detected accurately with a simple structure.

22 Claims, 22 Drawing Sheets

SORTER

BACKGROUND OF THE INVENTION AND RELATED ART STATEMENT

This invention relates to a sorter which causes a plurality of vertically spaced air, art bins to shift upward and downward to sort sheets out.

In recent years, in an image forming apparatus such as a copying machine and a printer for transferring the same document image to a plurality of copy sheets, there has been widely used a sorter for sorting these copy sheets out to a plurality of bins automatically. Particularly, there has been recently used a sorter provided with a function of applying a specified mechanical sheet processing to the sorted sheets on the bins by means of a stapler and a punch. Since the conventional sorter of this type is constructed such that the stapler or the like moves close to or away from the bin so as to apply the processing to the sheet, the stapling is applied only to a specified corner portion of the sheet.

Recently, there has been an increasing demand for a sorter capable of applying a plurality of types of sheet processing including the stapling and punching to a desired position in a widthwise direction of the sheet. The following can be considered as one type of this sorter. Specifically, the sorter is provided with a support moving mechanism for moving a single support having a sheet processor such as a stapler and a punch arranged side by side thereon in the widthwise direction of the bin, and a bin moving mechanism for moving the bin toward the sheet processor so as to apply the sheet processing to the sheets placed on the bin. The sheets placed on the bin having moved toward the bin are pressed by a sheet holder, and a rear end portion of the bin is opened up. Thereafter, the support is moved to a desired position to apply a specified processing to the sheets.

In the sorter thus constructed, the bins are shiftable upward and downward to a position where the bin moving mechanism is provided. Accordingly, a home position of a stack of bins must be detected accurately in order to move the bins reliably to the position where the bin moving mechanism is provided. Further, upper and lower limits of vertically movable range must be detected accurately in order to prevent a failure from occurring due to the fact that the bins are shifted beyond the upper and lower limits of the range. The sorter in which the bin is moved toward the sheet processor, the sheets are held, and the rear end portion of the bin is opened up in this order requires a relatively large time until the sheet processing is completed.

SUMMARY OF THE INVENTION

In view of the probiceps residing in the prior art, it is an object of the invention to provide a sorter capable of detecting a home position of a stack of bins and upper and lower limits of a vertically movable range of the bins accurately with a simple construction and shortening a time required to set a sheet placed on the bin in a sheet processor.

Accordingly, the invention is directed to a sorter for sorting sheets out comprising a bin unit including a plurality of bins having specified length and width, the bins being vertically spaced apart and adapted for placing the sorted sheets thereon; and a shifting means for shifting the bin unit upward and downward.

The sorter may further comprise a first detector means for detecting that the bin unit has been lowered to a home position region defined in a lower portion of the sorter; and a shift control means for controlling the shifting means, the shift control means shifting the bin unit downward until the first detector means conducts the detection when the bin unit is not in the home position region when the power is applied to the sorter.

The shifting means may preferably include a cylindrical cam provided rotatably upright and having a spiral groove defined on an outer circumferential surface thereof, the respective bins being engaged slidably with the groove of the cylindrical cam; and a cylindrical cam drive means for rotating the cylindrical cam.

The sorter may desirably comprise a second detector means for detecting that a reference direction in a rotating operation of the cylindrical cam is in agreement with a predetermined direction. The shift control means may control the cylindrical cam drive means to shift the bin unit downward until the detection is conducted by the first and second detector means when the bin unit is not in the home position region when the power is applied while to shift the bin unit upward until the detection is conducted by the second detector means when the bin unit is in the home position region and the reference direction of the cylindrical cam is at variance with the predetermined direction.

With the sorter thus constructed, it is discriminated whether the bin unit has been lowered to the home position region and the reference direction in the rotating operation of the cylindrical cam is in agreement with the predetermined direction when the power is applied to the sorter. Unless the bin unit has been lowered to the home position region, the bin unit is shifted downward until the bin unit is lowered to the home position region and the reference direction becomes in agreement with the predetermined direction.

When the bin unit is in the home position region but the reference direction is at variance with the predetermined direction, the bin unit is shifted upward until the reference direction becomes in agreement with the predetermined direction while maintaining the bin unit in the home position region.

Further, the sorter may advantageously comprise a projected member provided at the bin unit; a first detector means for detecting that the bin unit has been lowered to a home position by detecting the presence of the projected member; a second detector means including a detection lever provided projectingly below the first detector means in such a position as to cross a moving path of the projected member and adapted for detecting that the bin unit has reached a lower limit position when the projected member comes to contact with the detection lever; and a common guide means for guiding the projected member to the first detector means and to the contact position with the detection lever of the second detection means. The projected member may include a planar portion. The first detector means may include a slit-like sensing portion and detect that the bin unit has been lowered to the home position when the planar portion of the projected member is fitted in the sensing portion. The guide means may guide the projected member to contact positions with the sensing portion of the first detector means and with the detection lever of the second detector means.

With thus constructed sorter, when the bin unit is lowered and accordingly the projected member is lowered near the first detector means, the projected member is guided to the sensing portion of the first detector means reliably by the guide means. When the projected member is lowered to be located in the sensing portion, the bin unit is detected to have been lowered to the home position.

When the bin unit is further lowered, the projected member is guided by the guide means and comes to contact with a specified position of the detection lever of the second detector means. Thereupon, the projected member presses the detection lever down and it is detected that the bin unit has reached the lower limit position.

Each bin may preferably include at a rear end portion thereof a stopper for aligning a trailing edge of the sheet, the stopper being rotatable so as to open up the rear end portion of the bin. This sorter having the bins of this type may further comprise a rotating means for rotating the stopper; a sheet processing means provided behind the bins with respect to a lengthwise direction thereof and adapted for applying a specified processing to the sheet placed on the bin, the sheet processing means applying the processing to a portion of the sheet which is exposed when the stopper is rotated to thereby open up the rear end portion of the bin; and a moving means for moving the bin forward and backward so as to move the bin close to and away from the sheet processing means.

The sorter may further comprise a pressing means provided above the bin excluding the rear end portion movably upward and downward and adapted for pressing the sheet placed on the bin against the bin: and a biasing means for bringing the sheet pressing means into pressing contact with the sheet placed on the bin before the rear end portion of the bin is opened up. The sorter may preferably comprise a drive means for driving the rotating means according to the movement of the bin toward the sheet processing means.

With thus constructed sorter, the bin is moved toward the sheet processing means when the sheet processing is applied to the sheet placed on the bin. The pressing means presses the sheet placed on the bin against the bin by a biasing force acting downward to the pressing means before the rear end portion of the bin is opened up, and then the stopper is rotated to open up the rear end portion of the bin. The sheet processing is applied to the portion of the sheet exposed from the bin by the sheet processing means.

The sorter may further comprise a warp preventing member which comes to contact with the position of the bin excluding the rear end portion when the bin is moved toward to the sheet processing means so as to prevent the bin from warping.

With this arrangement, when the bin is retracted so as to apply the sheet processing to the sheet thereon, the warp preventing member comes to contact with the bin excluding the rear end portion at the specified position from below, thereby preventing the warping of the bin. Accordingly, the sheet can be set in the sheet processing means more reliably.

The sheet processing means may be advantageously capable of applying at least two types of sheet processing to the sheets placed on the bins. A sorter having this type of sheet processing means may comprise a mount means for mounting the sorter to an image forming apparatus, the image forming apparatus including a selecting means for selecting the type of sheet processing the sheet processing means applies to the sheets, the respective bins being arranged such that sheets discharged from the image forming apparatus are placed thereon; and a control means for causing the sheet processing selected by the selecting means to be executed automatically when the imaging operation is carried out.

The sorter may preferably comprise a designating means for designating the execution of the sheet processing selected by the selecting means of the image forming apparatus. The control means starts the sheet processing in accordance with the designation from the designating means.

With thus constructed sorter, the type of sheet processing is selected by the selecting means of the image forming apparatus and the execution of the sheet processing selected by the selecting means is designated by the designating means. Accordingly, it is prevented to designate the type of sheet processing erroneously.

These and other objects, features and advantages of the present invention will become more apparent upon a reading of the following detailed description and accompanying drawings .

DETAILED DESCRIPTION OF THE PREFERRED EMBODIMENTS OF THE INVENTION

Figure 1:
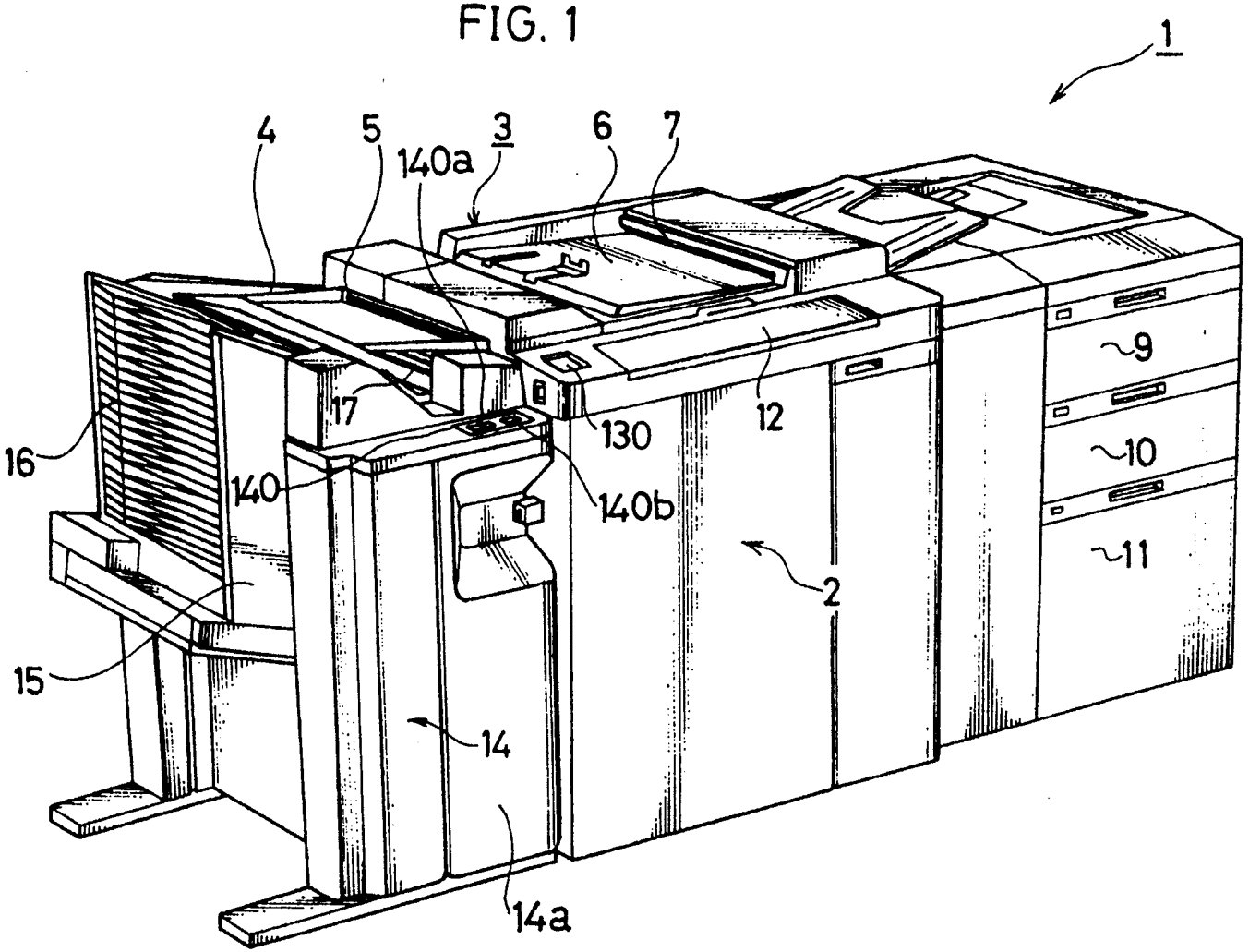
FIG. 1 is a perspective view showing an exterior of an image forming apparatus incorporating a sorter according to the invention.

A sorter embodying the invention will be described with reference to the drawings. There will be first described an image forming apparatus incorporating the sorter according to the invention with reference to FIGS. 1 to 3. FIG. 1 is a perspective view showing an exterior of the image forming apparatus 1.

The apparatus 1 is provided with an image forming unit 2, an automatic document feeder 3, a sorting unit 14, and the like.

At a center of a top surface of the image forming unit 2 is provided an unillustrated transparent document platen. In the image forming unit 2 are provided an optical system for scanning a document image optically, an image forming assembly including a photosensitive member and devices arranged around the photosensitive member for forming an image, a transport assembly for transporting a copy sheet, and the like. A document to be copied is placed on the document platen with a surface to be copied faced downward. The document surface is scanned optically by the optical system. Based on a reflected light from the document surface is formed an electrostatic latent image on the photoface sensitive member by the image forming assembly. The latent image is developed into a toner image. The developed toner image is transferred to a copy sheet and is fixed thereon in a fixing device.

The automatic document feeder 3 transports documents automatically, and includes a document setting portion 4, document inlet 5, document transport assembly 6, and a document discharge tray 7. The documents placed on the document setting portion are transported one by one to a specified position on the document platen automatically by the document transport assembly 6 through the document inlet 5, and are caused to pause thereat. After the copying operation, the documents are discharged onto the document discharge tray 7. Cabinets 9, 10, 11 are designed to contain copy sheets therein. Variously sized copy sheets are allowed to be set in these cabinets.

Figure 2:
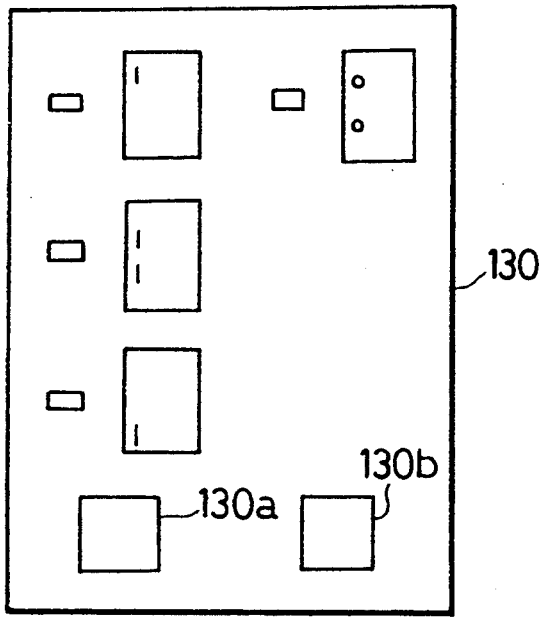
FIG. 2 is a plan view showing an operation panel provided in an image forming unit.

Operation panels 12, 130 are provided at a front side of the top surface of the image forming unit 2. The operation panel 12 is used to manipulate the image forming apparatus, and includes a copying switch, switches for designating the number of copies to be made, display units for indicating setting contents, and the like. The operation panel 130 includes a sheet processing selection keys 130*a*, 130*b* for selecting positions where a plurality of standardized stapling and punching are applied (sheet processing modes) as shown in FIG. 2. The sheet processing selection key 130*a* is manipulated to select cyclically three types of stapling on the operation panel 130.

The sorting unit 14 is provided with a door 14*a* which is openably and closably mounted to a main body of the sorting unit 14. By opening the door 14*a*, a sheet processing device 30 to be described later is allowed to be withdrawn. A bin unit 15 is adapted for sorting copying sheets, and includes a plurality of bins 16 movable in a vertical direction. The copy sheets are discharged one after another on the bins 16 in the case where they are sorted. On the other hand, the copy sheets are discharged onto a discharge tray 17 in the case where they are not sorted.

Figure 3:
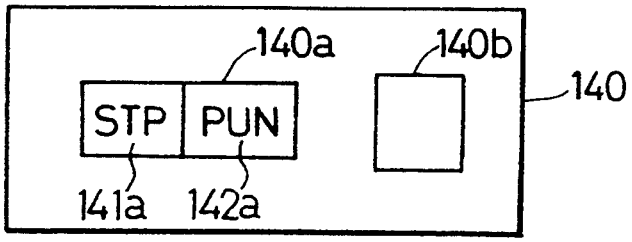
FIG. 3 is a plan view showing an operation panel provided in a sorting unit.

An operation panel 140 is provided at a front side of a top surface of the sorting unit 14, and includes a display unit 140*a* and a processing execution key 140*b* as shown in FIG. 3. The display unit 140*a* includes display lamps 141*a*, 142*a* for displaying the sheet processing mode selected through the operation panel 130. For example, the display lamp 141*a* is turned on when the stapling is selected as a sheet processing mode, whereas the display lamp 141*b* is turned on when the punching is selected as a sheet processing mode. Both the display lamps 141*a*, 142*a* are turned on upon the selection of the sheet processing mode including the stapling and the punching. The processing execution key 140*b* is manipulated to designate the selected sheet processing mode.

Next, an interior construction of the sorting unit 14 will be described with reference to FIGS. 4A to 4E and 5. FIG. 4 is a sectional view showing the bin unit 18 and sheet processing device 30 accommodated in the sorting unit 14.

The sheet processing device 30 is detachably mountable in the sorting unit 14, and includes a sheet processor 28, a support 29, a frame 31*a*, etc.

Figure 5:
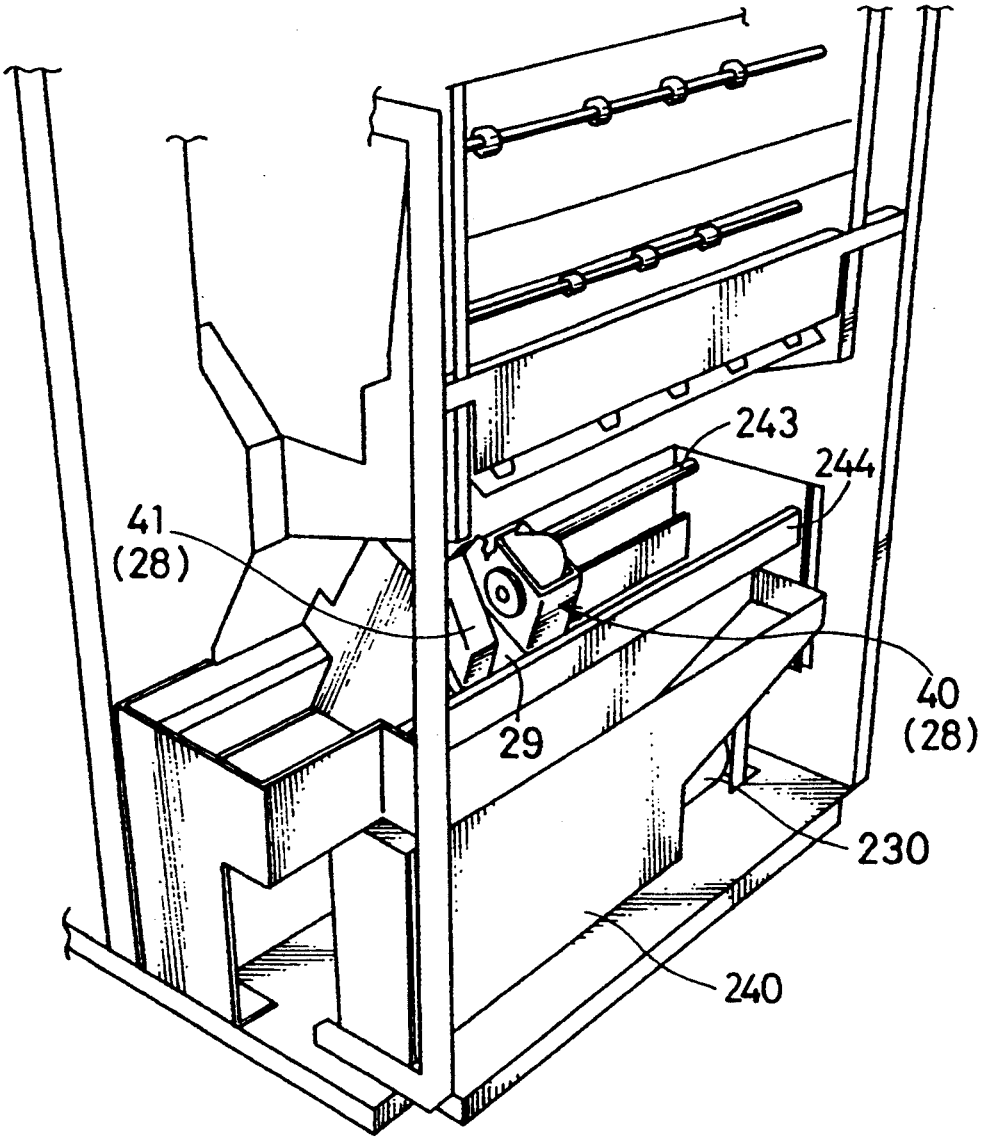
FIG. 5 is a perspective view showing a sheet processor provided in the sorting unit of the image forming apparatus.

The sheet processor 28 applies a specified processing to the sets of copy sheets sorted into the bins 16, and is mounted on the support 29. The sheet processor 28 includes a punch 40, a stapler 41, and the like for applying a specified processing such as punching and stapling to the sets of copy sheets placed on the bins 16 arranged side by side on the support 29 as shown in FIG. 5.

The support 29 has a front portion thereof supported slidably on a shaft 243, and has a rear portion thereof supported slidably on a rail 244 through rollers 29*a* arranged thereat. The shaft 243 and the rail 244 extend in a widthwise direction of the bins 16 as shown in FIG. 5.

A belt 29*b* is wound on pulleys 29*c*, 29*d*, and a pulley 32*a* rotatable together with a motor 32. The support 29 is fixed to the belt 29*b* at a connecting portion provided at front end of the support 29.

When the pulley 32*a* rotates according to the rotation of the motor 32, the belt 29*b* moves to thereby move the support 29 in the widthwise direction of sheets.

In this way, the sheet processor 28 is permitted to apply the specified processing to an arbitrary position at the trailing edge portion of the set of copy sheets by moving the support 29 on the shaft 243 and the rail 244.

The sheet processor is detachably mountable on the support 29. Paper waste from the punch 40 is introduced to a waste container 240 long in the widthwise direction.

There will be described a construction of a rear end portion of the bin 16 (stopper 25) next with reference to FIGS. 6 to 10.

Figure 6:
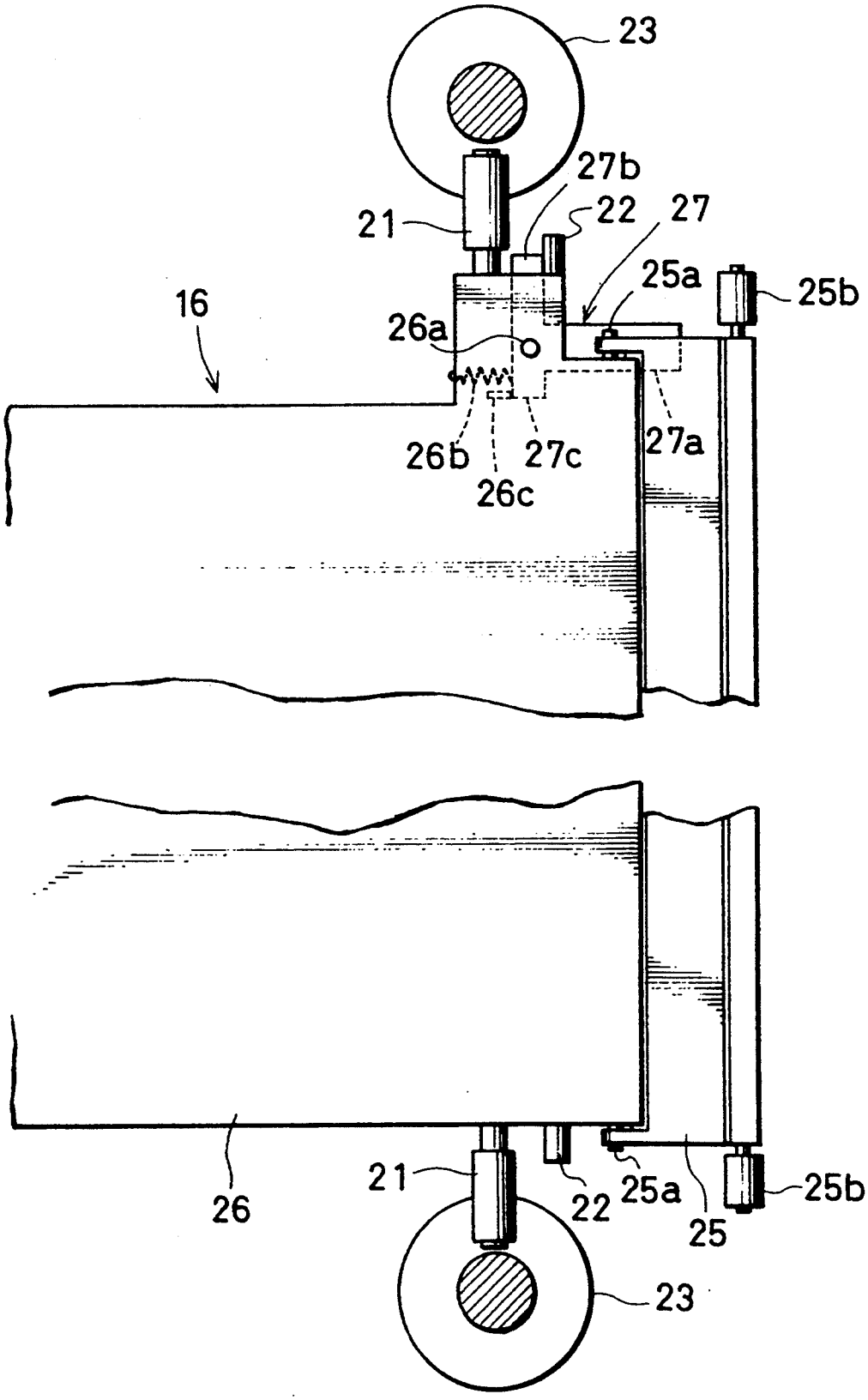
FIG. 6 is a plan view in section showing the construction of a bin.
Figure 7:
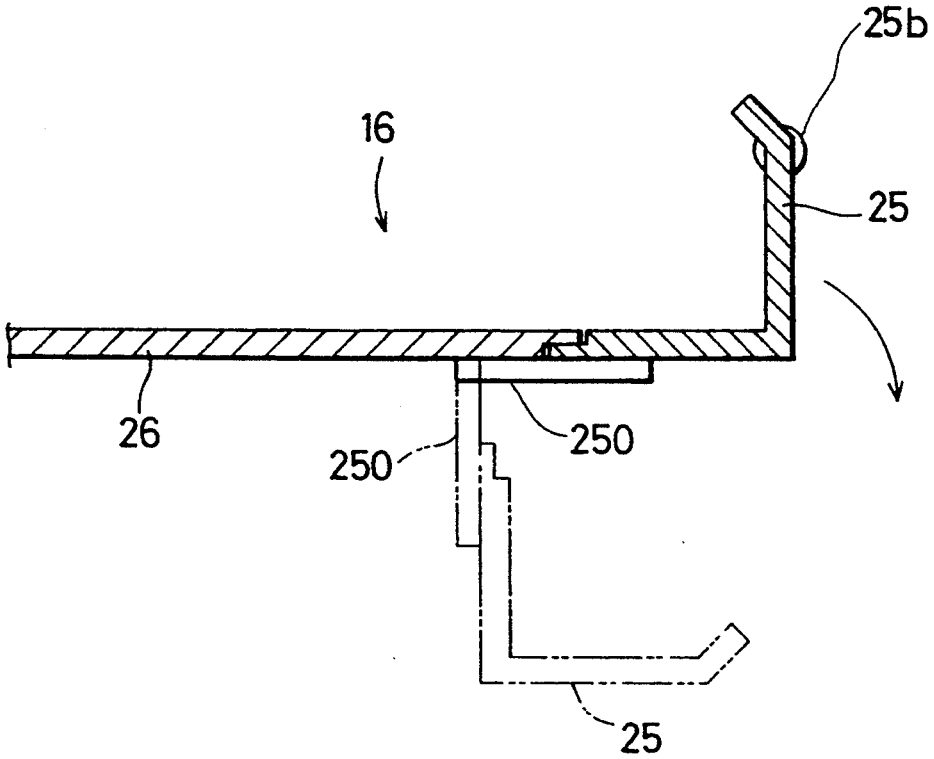
FIG. 7 is a sectional view showing the shapes of a planar portion and a stopper of the bin.
Figure 8:
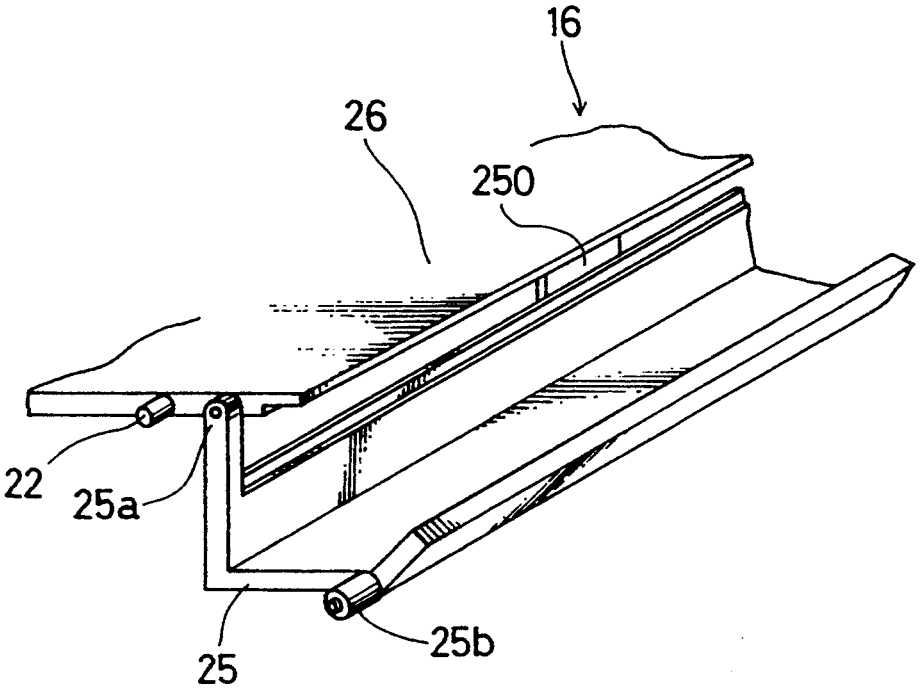
FIG. 8 is a perspective view showing a state where the stopper is released.
Figure 9:
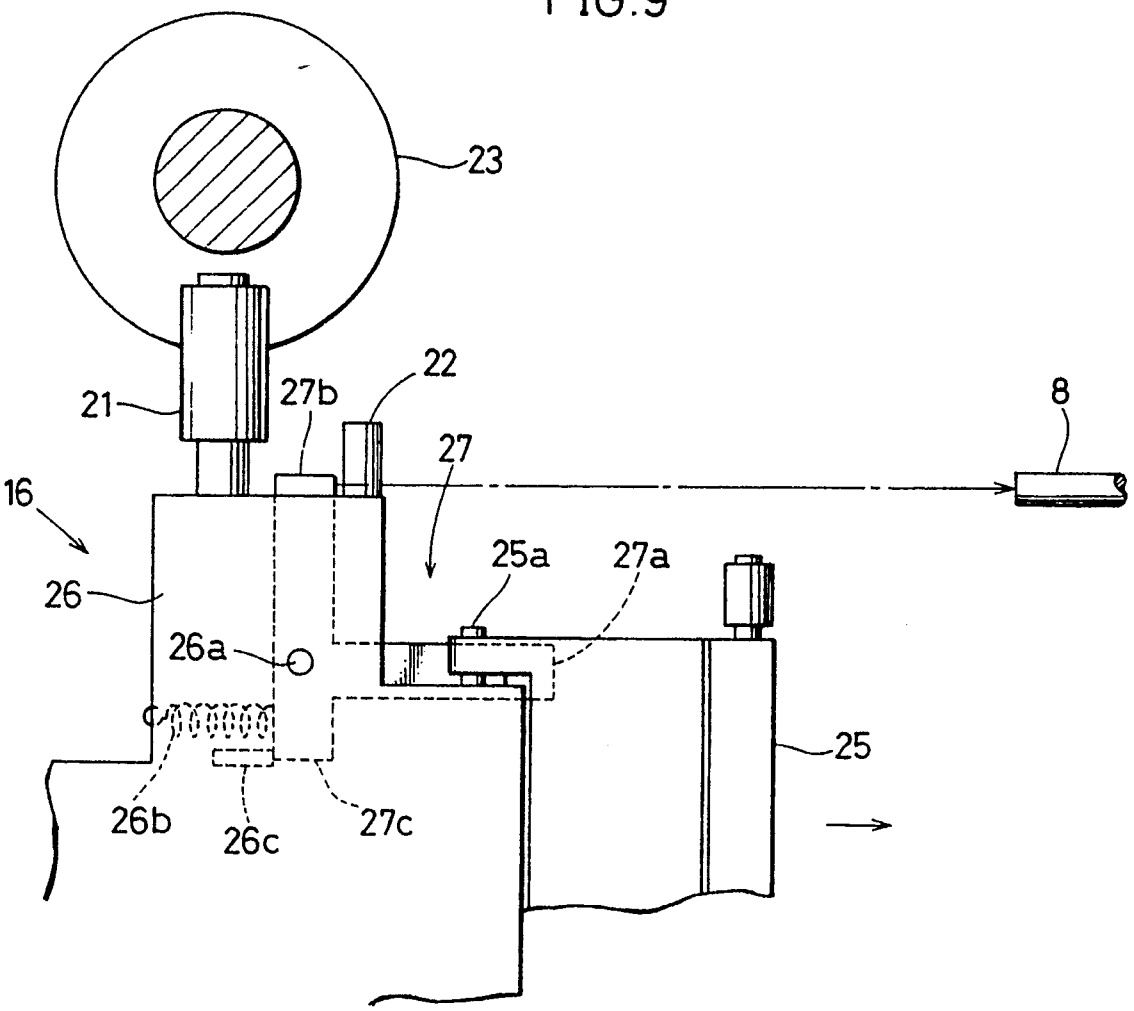
FIG. 9 is a plan view showing a positional relationship between refraining and releasing members.
Figure 10:
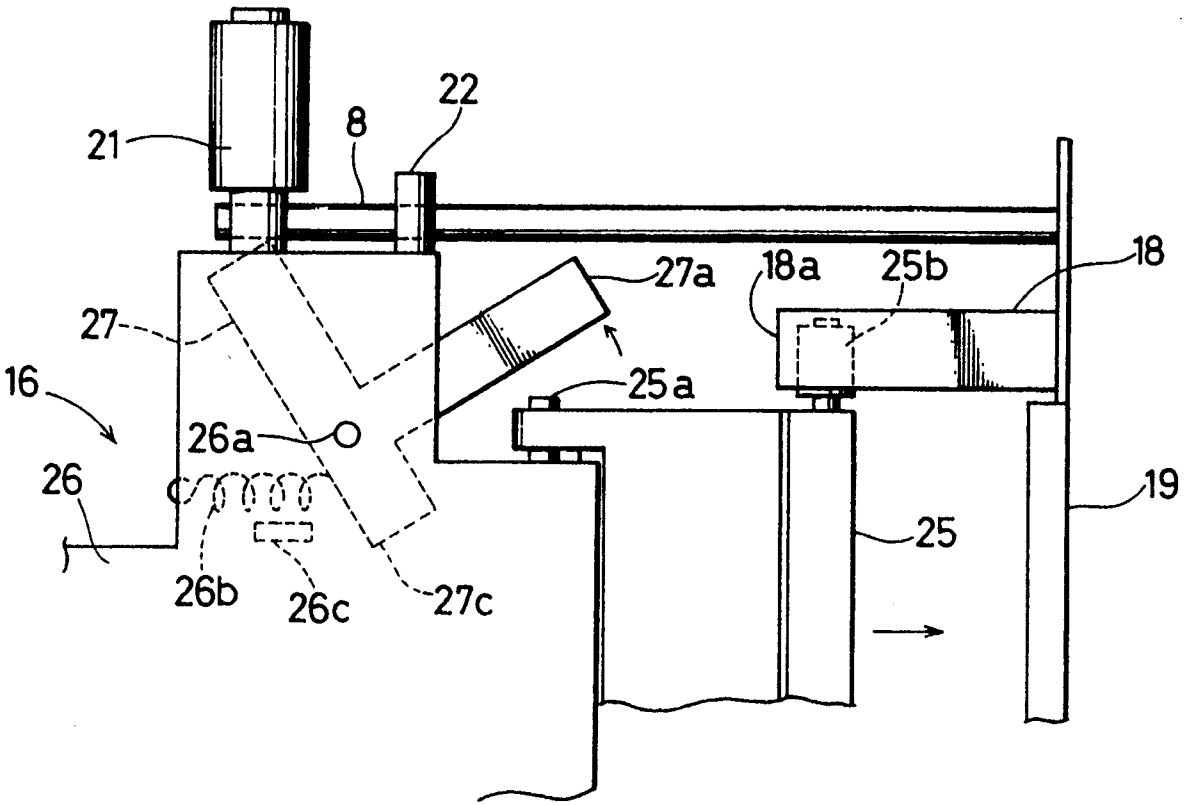
FIG. 10 is a plan view showing a state where the releasing member comes to contact with the refraining member to thereby disengage the refraining member from the stopper.

The stopper 25 is supported rotatably about a supporting point 25*a* at opposite lateral ends of the planar portion 26 as shown in FIG. 6. At a widthwise center of a base portion of the stopper 25 is provided a projected portion 250 extending forward of the stopper 25 as shown in FIGS. 7 and 8. A leading end face of the projected portion 250 comes to contact with the underside of the planer portion 26 when the stopper 25 rotates downward about the supporting point 25*a* to a position as indicated by phantom line in FIG. 7, thereby preventing the planar portion 26 from warping due to the weight of the copy sheets placed on the bin 16. The widthwise dimension of the projected portion 250 may be set at a desired value. It may be appropriate to arrange a plural of projected port ions 250 in the widthwise direction of the stopper 25.

At each of opposite lateral ends of the leading end of the stopper 25 is provided a roller 25*b*, which is fitted in a guide rail 18 to be described later when the bin 16 is retracted.

The planar portion 26 has a projected portion formed at a rear right side thereof (an upper side in FIG. 6) as shown in FIG. 6. A substantially T-shaped refraining member 27 is connected rotatably to the underside of the projected portion through a supporting point 26*a*. This refraining member 27 includes a refraining piece 27*a*, a releasing piece 27*b*, and a restricting piece 27*c*, which are rotatable about the supporting point 26*a*. The releasing piece 27*b* extends to the right of the bin releasing member 8 to be described later comes to contact with the releasing piece 27*b*. The restricting piece 27*c* is connected to the planar portion 26 through a spring 26*b*, which biases the refraining member 27 in a clockwise direction in the drawing of FIG. 6. The refraining piece 27*a* is sized sufficiently long to reach the underside of the stopper 25, and refrains the stopper 25 from rotating downward due to the weight thereof in a refraining state shown in FIG. 6. A contact member 26*c* is formed into a projection on the underside of the planar portion 26. The restricting piece 27*c* comes to contact with the contact member 26*c* by the biasing force of the spring 26*b*, thereby restricting the further clockwise rotation of the refraining member 27 to maintain a refraining state.

The releasing member projects forward from a rear frame of the bin unit 15 on a backward moving path of the releasing piece 27*b*. When the bin starts being retracted from the state shown in FIG. 9, the releasing piece 27*b* comes to contact with the releasing member 8 causing the refraining member 27 to rotate counterclockwise (releasing state). In this releasing state, the stopper 25 is permitted to rotate downward. This state is maintained until the bin 16 is retracted to a most backward position.

Figure 11A:
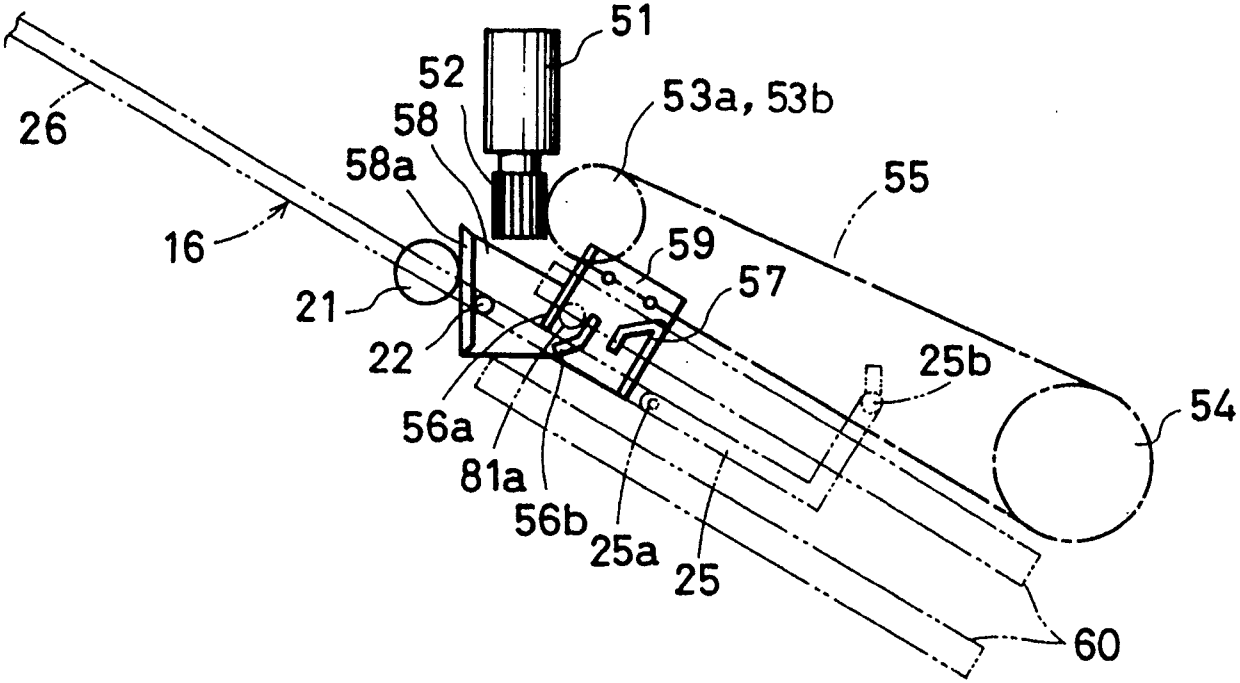
FIGS. 11A, 11B are diagrams showing the construction of a bin moving mechanism, FIG. 11A being a schematic side view and FIG. 11B being a perspective view showing an essential portion.
Figure 11B:
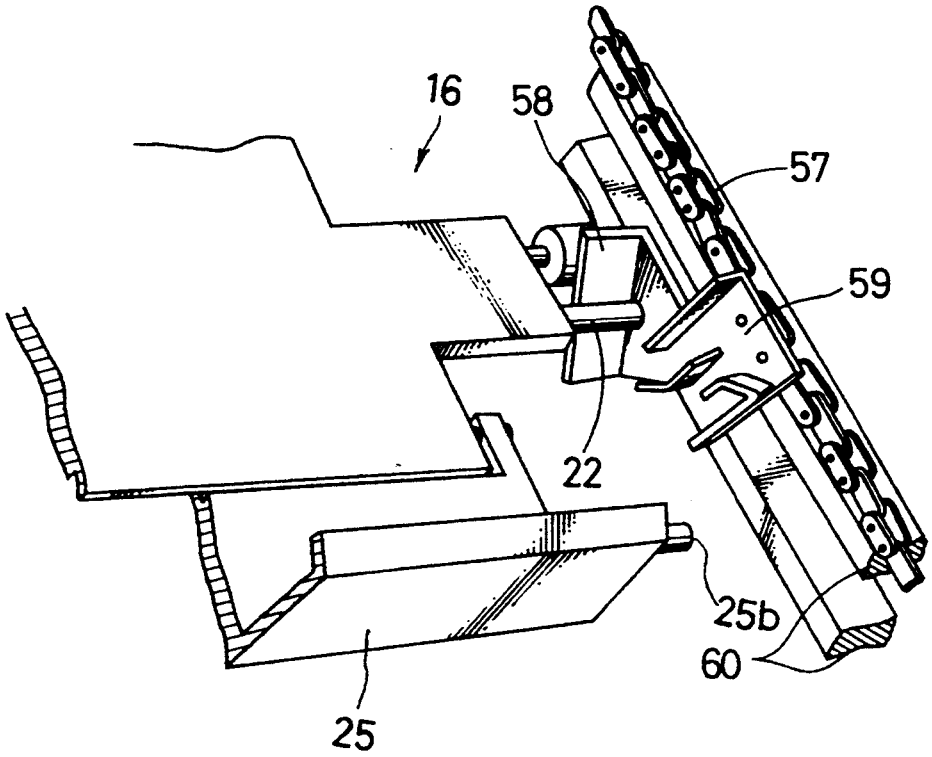

There will be described the movement of the bins 16 with reference to FIGS. 11A and 11B. FIG. 11A is a schematic side view showing the construction of a bin moving mechanism, and FIG. 11B is a perspective view showing an essential portion of the same.

The bin moving mechanism is designed to move the bin 16 in a lengthwise direction of the bin 16. This mechanism includes a motor 51, and drive transmission mechanisms each having sprockets 53*b*, 54 and a chain 55. The drive transmission mechanism is provided at each of opposite sides of the bin 16. The motor 51 is coupled with one of the drive transmission mechanisms. The driving force of the motor 51 is transmitted to the other drive transmission mechanism through a connecting shall connecting the sprockets 53 disposed at the opposite sides. The driving force of the motor 51 is transmitted to a worm wheel 53*a* through a worm 52, thereby rotating the sprocket 53*b* fixedly mounted on the same shaft as the worm wheel 53*a*, and rotating the chain 55 wound on the sprockets 53*b*, 54.

An operable member 58 is secured to each of the chains 55 at a connecting portion. The operable member 58 includes an upright operable piece 58*a* provided between second and third pins 21 and 22. According to the rotation of the chain 55, this operable piece 58*a* pushes the second pin 21 or third pin 22 to thereby move the bin 16 forward or backward. The operable piece 58*a* is also adapted for keeping the second pin 21 from being disengaged from the spiral groove 24 while the sorting is carried out.

The operable member 58 is also provided with fitting members 56*a*, 56*b* to which a shaft 81*a* of a sheet holder 81 for holding the sheets is fitted and a guide member 57 for guiding a chain 79. By guiding the chain 70 with the guide member 57, the shaft 81*a* is fitted between the fitting members 56*a* and 56*b* (a state indicated by phantom line in FIG. 12). A pair of guide rails 60 guide the second pins 21 so as to guide a moving direction of the bin 16. The operable member 58 is detected by an unillustrated position sensor including a photointerrupter. A detection result of this position sensor is output to a controller 161 to be described later. The driving of the motor 51 is controlled by the controller 161 to thereby control the movement of the operable members 58.

With thus constructed bin moving mechanism, the operable members 58, i.e. the bin 16, are permitted to move reciprocally within a specified range according to the rotation of the motor 51.

There will be described a holder moving mechanism for moving a sheet holder next with reference to FIG. 12.

The holder moving mechanism is adapted for moving the sheet holder 81 integrally with the bin 16 simultaneously or releasing an integrated state of the sheet holder 81 with the bin 16. The holder moving mechanism is provided with motor 71 and drive transmission mechanisms each including sprockets 73 to 78 and a chain 79. This drive transmission mechanism is mounted on a frame at each of opposite sides of the bin 16. The motor is coupled with one of the drive transmission mechanisms. The driving force of the motor 71 is transmitted to the other drive transmission mechanism through a connecting shaft connecting the sprockets 73 disposed at the opposite sides. The driving force of the motor 71 is transmitted to a worm wheel 731 through a worm 72, thereby rotating the sprocket 73 fixedly mounted on the same shaft as the worm wheel 731, and rotating the chain 79 wound on the sprockets 73 to 78.

The chain 79 is so arranged as to pass between the fitting member 56*b* and the guide member 57. The shaft 81*a* of the sheet holder 81 is fixed to connecting portions of the chains 79 disposed at the opposite sides above the bin 16 between the sprockets 74 and 76.

To the sprocket 74 is connected an arm 75*a* having one end thereof supported rotatably. The other end of the arm 75*a* is connected rotatably to the sprocket 75. Accordingly, the sprocket 75 is supported pivotally about the shaft of the sprocket 74 and is biased in the clockwise direction in the drawing of FIG. 12 by a spring 75*b* connected between an unillustrated frame and the arm 75*a*. The sprocket 77 is movable upward and downward and is biased downward. Thus, the chain 79 is subjected to a specified tension lest the respective sprockets should get out of meshed positions.

There will be next described an operation of the holder moving mechanism. When the motor 71 is driven to rotate the chains 79, the connecting portions 80 move toward the bin 16 and thereby the shaft 81*a* is fitted between the fitting members 56*a* and 56*b*. In this fitting state, the sheet holder 81 is brought into a state where it is movable integrally with the bin 16. The motor 71 is locked in a deenergized state lest the chains 79 should rotate idly while the motor 71 is in this state. As a result, the state where the sheet holder 81 is movable integrally with the bin 16 is not released inadvertently.

In a state where the shaft 81*a* is fitted between the fitting members 56*a* and 56*b*, the sheet holder 81 is retractable integrally with the operable members 58, i.e. with the bin 16. According to the retraction of the operable members 58, the chains 79 are pulled backward. However, since the arms 75*a* pivot according to the movement of the chains 79 to thereby move the sprockets 75 backward, the tension acting on the chains 79 can be maintained.

There will be described a sheet holding mechanism for holding the sheets with the sheet holder 81 next with reference to FIGS. 13 and 14.

A biasing member 33 is disposed at each of frames provided at opposite sides of the bin 16. This biasing member 33 comes to sliding contact with the shaft 81*a* of the sheet holder 81 while the bin 16 is being retracted, thereby biasing the shaft 81*a* downward by a specified biasing force. The biasing member 33 has an intermediate position thereof supported on a plane normal to the frame rotatably about a supporting point 33*a*, and has an end portion thereof close to the bin 16 bent downward so that a lower end thereof is slidably in contact with the shaft 81*a*.

Figure 14:
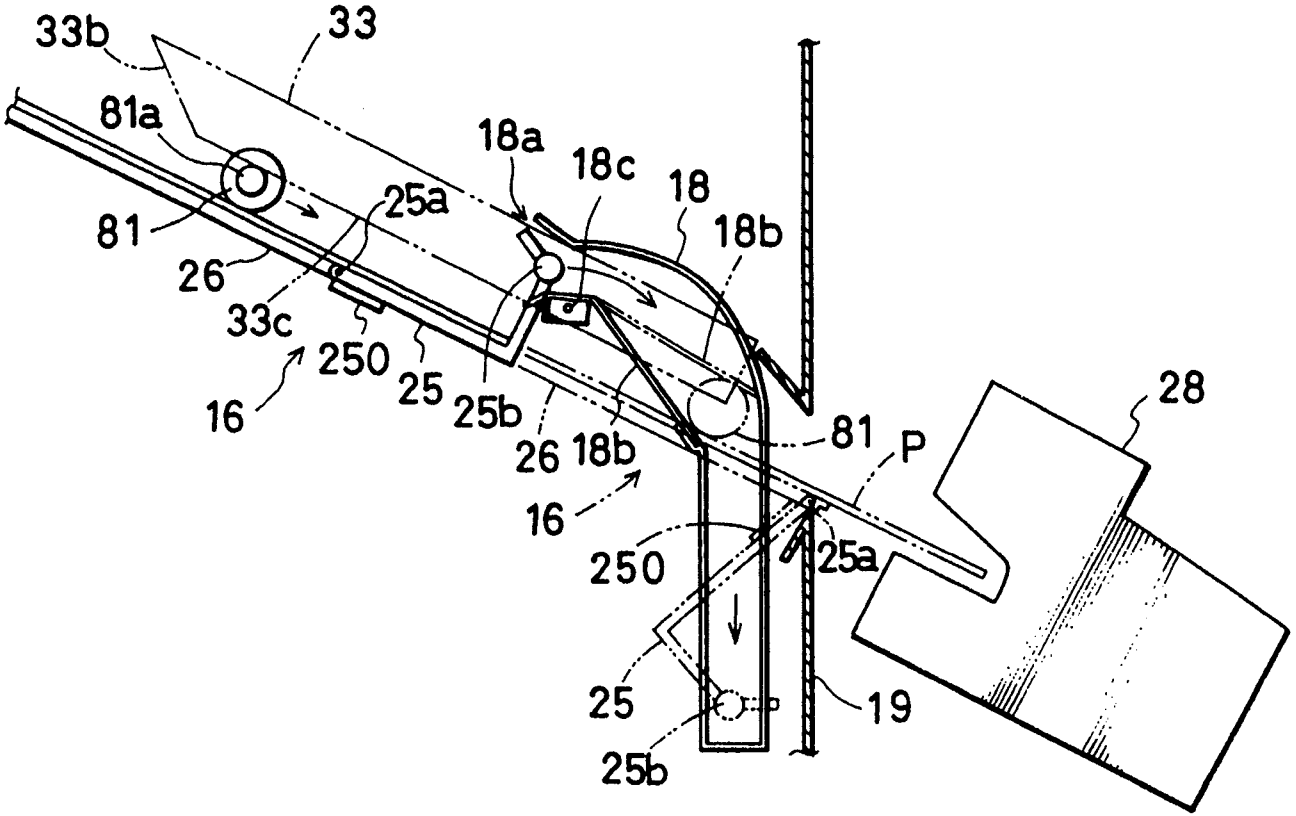
FIG. 14 is a schematic side view showing a sheet holding mechanism and a stopper releasing mechanism.

The end portion of the biasing member 33 close to the bin 16 has a tapered portion formed at a front end portion 33*b* as shown in FIG. 14, and guides the shaft 81 in contact with the front end portion 33*b* to a lower end portion 33*c* according to the retraction of the bin 16. The inclination and shape of the tapered portion can be set desirably. Since the biasing force is applied gradually by providing the tapered portion, a sudden load is not exerted on the bin 16 thereby preventing the bin 16 from warping.

Figure 13:
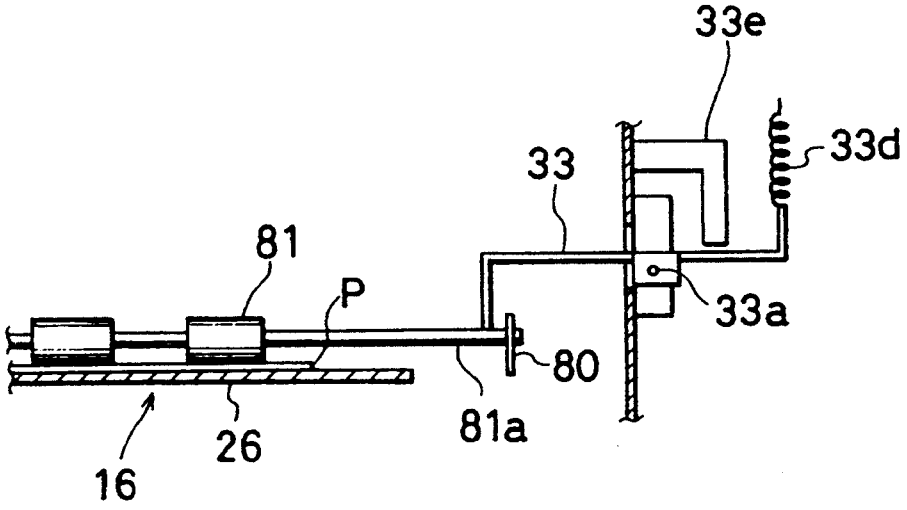
FIG. 13 is a sectional view showing essential portions of a sheet holder and a biasing mechanism.

In FIG. 13, a spring 33*d* is provided between an end portion of the biasing member 33 away from the bin 16 and a main body of the sorting unit 14. This spring 33*d* biases the biasing member 33 in a counterclockwise direction in the drawing of FIG. 13. By the biasing force given from this spring 33*d*, the biasing member 33 presses the shaft 81*a* at a given pressing force. A rotation range of the biasing member 33 is restricted by a restricting member 33*e* disposed at the frame, so that a pressing force greater than a necessary level is not exerted on the bin 16.

In this way, the copy sheets on the bin 16 are pressed by the biasing force given from the biasing member 33, and are accordingly prevented from being displaced and falling even when the stopper 25 is released and a rear end of the bin 16 is opened.

There will be described a mechanism for rotating and releasing the stopper 25 next with reference to FIG. 14.

A guide rail 18 is arranged at each of opposite sides of the bin 16, and is adapted for guiding the roller 25*b* of the stopper 25 downward in releasing the stopper 25. The guide rail 18 consists of a pair of rails for defining a guide path. An opening 18*a* is provided on a backward moving path of the roller 25*b* so that the roller 25*a* is inserted into the guide path. The roller 25*b* is inserted through the opening 18*a* at latest until the refraining piece 27*a* is disengaged from the stopper 25 (the releasing state of FIG. 10).

The guide rail 18 is formed into a specified arc extending downward behind the opening 18*a*. Accordingly, the roller 25*b* is guided downward in a state where it is in sliding contact with the guide rail 18 as the bin 16 is retracted. Thus, the stopper 25 rotates downward gradually. Since the rear end of the bin 16 is opened up gradually, an impact generated when the projected portion 250 of the stopper 25 comes to contact with the underside of the planar portion 26 is moderated. In order to assist the releasing of the stopper 25, it may be appropriate to mount an elastic guide plate formed of polyester film or the like for pressing the roller 25*b* of the stopper 25 down along a guide surface of the upper rail of the guide rail 18 so as to release the stopper 25.

The lower guide member 18*b* behind the opening 18*a* is supported rotatably on a shaft 18*c* mounted rotatably on the lower side of the opening 18*a*, and is biased by an unillustrated biasing mechanism in such a direction as to close the opening 18*a*. The lower guide member 18*b* forms a recess when the sheet holder 81 comes to contact therewith according to the retraction of the bin 16 as indicated by phantom line in FIG. 14, so that the movement of the sheet holder 81 by the guide 18 is not deterred.

Figure 15:
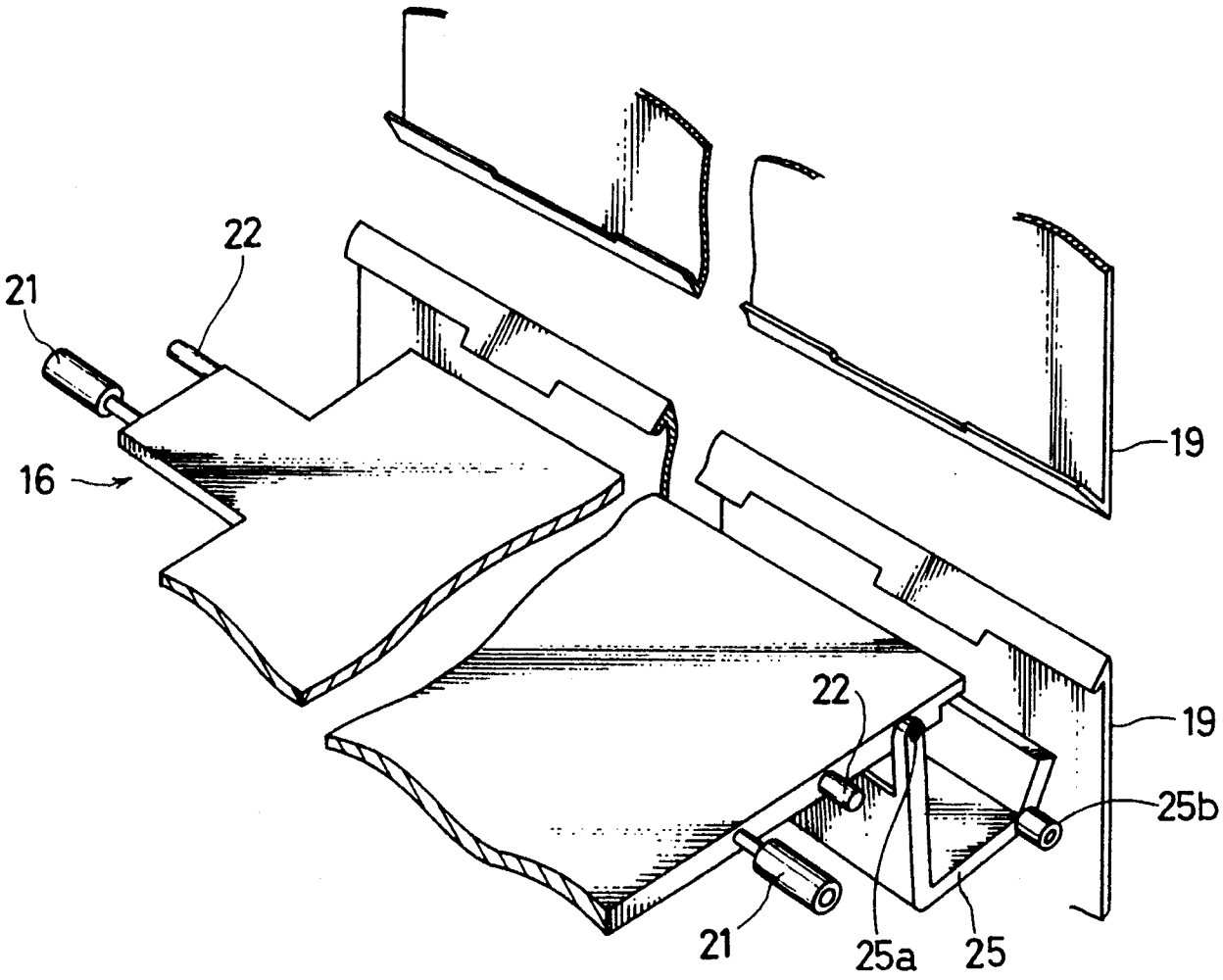
FIG. 15 is a perspective view showing a positional relationship between a warp preventing member and the bin.

A warp preventing member 19 extends in the widthwise direction of the bin 16 at a position behind the bin 16 as shown in FIGS. 14 and 15. The member 19 comes to sliding contact with the underside of the rear end portion of the planar portion 26 when the bin 16 is retracted and the rear end portion thereof is opened up, so as to prevent the warping of the planar portion 26 due to the weight of the copy sheets on the bin 16. An upper portion of the warp preventing member 19 is bent forward so as to guide the retracting bin 16 to an upper end thereof.

Figure 4A:
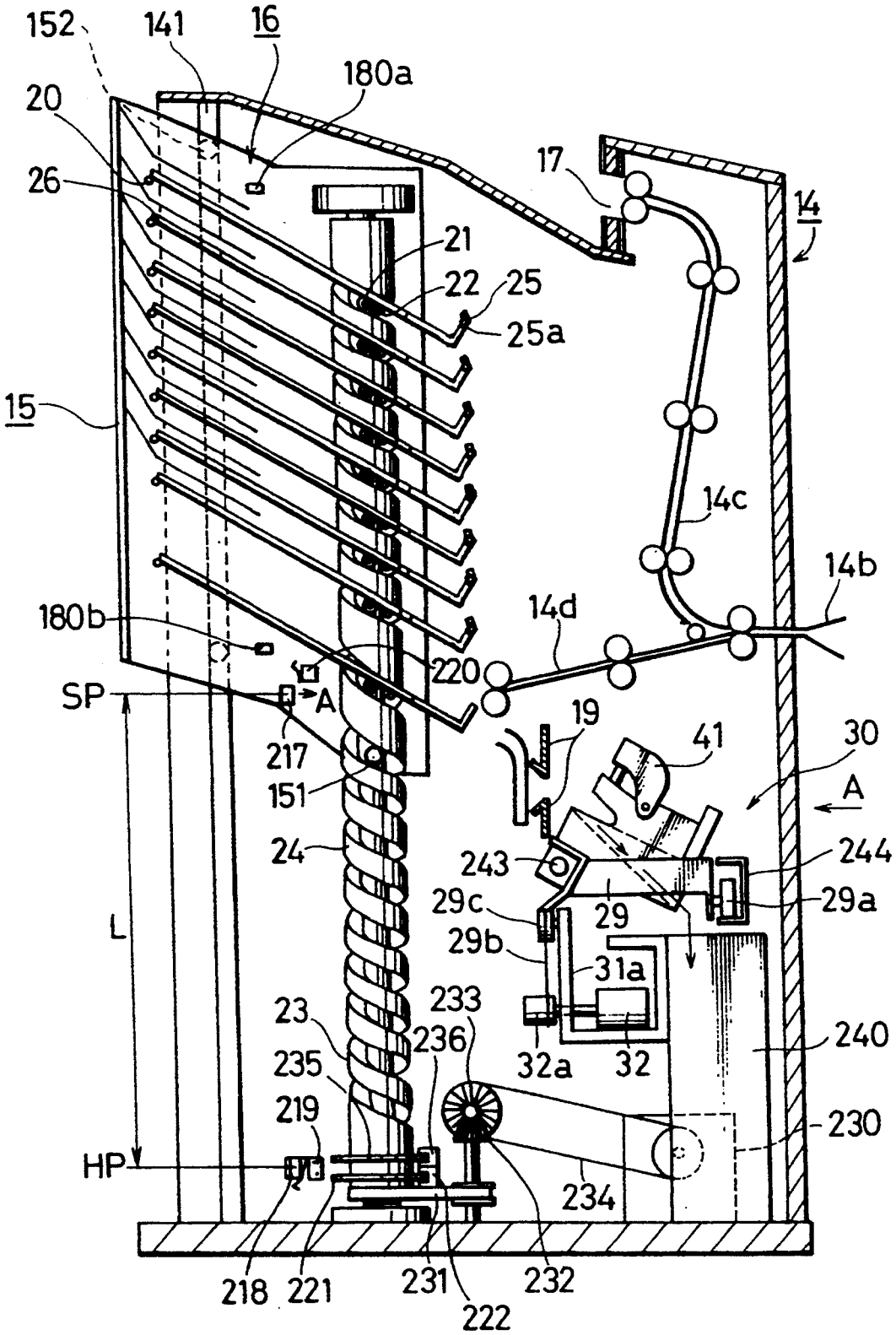
FIG. 4A is a vertical sectional view showing the sorting unit of the image forming apparatus.

In a specified position of the sorting unit 14 at the right side in the drawing of FIG. 4A is formed a sheet inlet 14*b* through which the copy sheets discharged from the image forming unit 2 are introduced to the sorting unit 14. Downstream of the inlet 14*b* are provided a transport path 14*c* for transporting the copy sheets to the discharge tray 17 and a transport path 14*d* for transporting the copy sheets to the bin unit 15.

The bin unit 15 is arranged downstream of the transport path 14*d* and the sheet processing device 30 is arranged below the transport paths 14*c*, 14*d*.

At upper and lower ends of the bin unit 15 is each arranged a sheet sensor 180 such as a photointerrupter including a light emitting element 180*a* and a photodetector 180*b*. At the same position of the respective bins 16 are defined unillustrated holes through which the light from the light emitting element 180*a* passes. When the sheets are placed on the bins 16, the tight from the element 180*a* is shielded to thereby enable the sheet sensor 180 to detect the presence of sheets on the bins 16.

A cylindrical cam 23 is provided upstanding at each of opposite sides of the bins 16 for shifting the bins 16 upward and downward. On a circumferential surface of the cylindrical cam 23 is defined a spiral groove 24. A bottom end of the cylindrical cam 23 is connected to a motor 230 by way of a timing belt 231, bevel gears 232 and 233, and a timing belt 234. When the motor 230 is driven, the driving force thereof is transmitted to the cylindrical cam 23 by way of the timing belt 234, bevel gears 233, 232, and timing belt 231, and thereby the cylindrical cam 23 is rotated.

Each bin 16 is formed of synthetic resin or like material, and includes a planar portion 26 for placing the copy sheets thereon and a substantially L-shaped stopper 25 provided at a rear end of the portion 26 for restricting and aligning trailing edges of the sheets. These members will be described more in detail later.

Each bin 16 has first pins 20 provided in such a manner as to project outward from opposite sides thereof. At specified positions of the opposite sides of the rear end portion of the bin 16 are provided second and third pins 21, 22 at a specified spacing in such a manner as to project outward.

The first pins 20 are fitted in unillustrated guide grooves defined on inner surfaces of opposite side walls of the bin unit 15. The guide grooves are tilted downward to the right in the drawing of FIG. 4A. The first pins 20 are designed to hold the bin 16 inclined by a specified angle with respect to a horizontal direction when being engaged with the guide grooves and to assist the sliding of the bin 16 when the sheet processing is applied. By the inclination of the bin 16, the discharged copy sheets are caused to slide down to the rear end portion thereof until coming to contact with an upright rear wail of the stopper 25. As a result, the trailing edges of the copy sheets are aligned.

The third pins 22 are arranged away from the corresponding second pins 21 by a specified distance to the right in FIG. 4A. The third pins 22 are engaging pins for getting the second pins 22 out of the cylindrical cams 23 when the bin 16 is slid toward the sheet processing device 30.

Each second pin 21 includes a roller mounted thereon rotatably at a leading end thereof. The rollers are fitted in the grooves 24 of the cylindrical cams 23, so that the bin 16 is supported shiftably upward and downward according to the rotation of the cylindrical cams 23.

The bin unit 15 has opposite side walls. A fifth pin 151 is provided at a lower end position of each side wall in such a manner as to project outward, and a sixth pin 152 is provided at an upper end position of each side wall in such a manner as to project outward. The fifth pins 151 are fitted in the grooves 24 of the cylindrical cams 23, and support the bin unit 15 shiftably upward and downward according to the rotation of the cylindrical cams 23. The sixth pins 152 are fitted in guide grooves 141 defined in the sorting unit 14, and guide the vertical movement of the bin unit 15. Thus constructed, the bin unit 15 is shiftable upward and downward in association with the bins 16.

The sorting of the copy sheets is carried out by shifting the bins 16 in the bin unit 15 upward or downward stage by stage to a sorting position SP above a home position HP defined at a lower position of the sorting unit 14 by a specified distance L while discharging the copy sheets on the bins 16. The distance L is set such that the uppermost bin 16 is set in the sorting position SP when the bin unit 15 is in the home position HP. When a specified processing to be described later is applied to sets of copy sheets upon completion of the copying and sorting operations, the bins 16 bearing sets of copy sheets thereon are shifted upward or downward stage by stage so that the one bearing a set of copy sheets to be processed is set in an operative position. In addition, the bin 16 in the operative position is retracted (to the right in the drawing of FIG. 4A) by a predetermined distance along a tilting direction thereof.

When the sorting of the copy sheets is designated, the bin unit 15 is shifted to the hone position HP by rotating the cylindrical cams 23, thereby shifting the uppermost bin 16 to the sorting position SP. A stack of bins 16 are shifted upward or downward stage by stage in synchronism with a discharging timing of the copy sheet. The copy sheet is discharged onto the bin 16 moved to the sorting position SP.

At a specified position of the lower end of the bin unit 15 is provided a sensor plate 217 for detecting the level (vertical position) of the bin unit 15. On the other hand, at a specified position of the lower portion of the sorting unit 14 are provided a bin unit home sensor 218 for detecting that the bin unit 15 has been lowered to a specified narrow home position region including the home position HP and a lower abnormality sensor switch 219 for detecting the abnormality in a downward moved amount of the bin unit 15. At a specified position of an intermediate portion of the sorting unit 14: is provided an upper abnormality sensor switch 220 for detecting the abnormality in an upward moved amount of the bin unit 15.

Figure 4B:
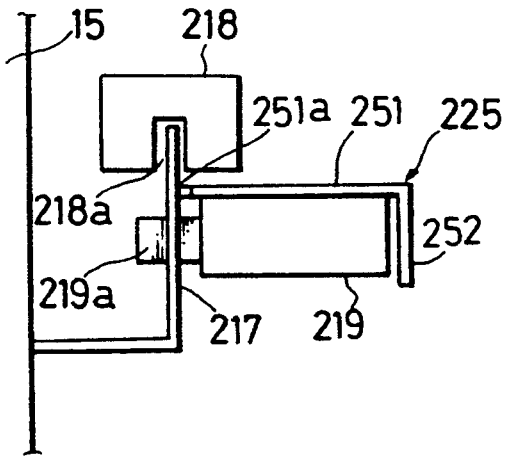
FIG. 4B is a plan view showing mounted states of a bin unit home sensor and a lower abnormality sensor switch.
Figure 4C:
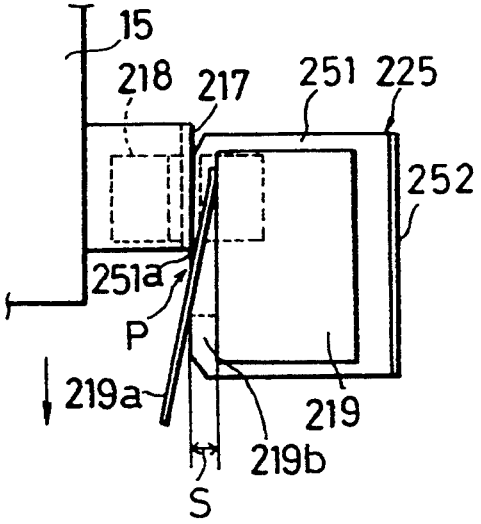
FIG. 4C is a front view showing mounted states of the bin unit home sensor and the lower abnormality sensor switch.
Figure 4D:
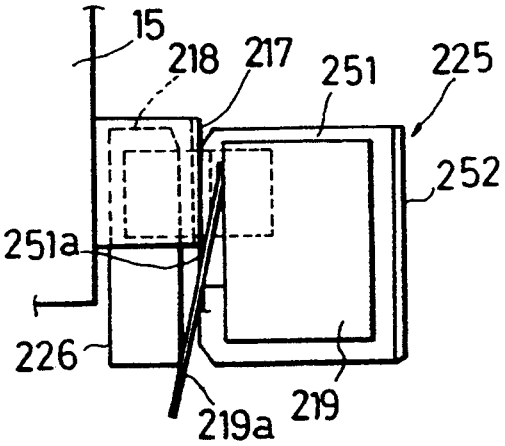
FIG. 4D is a front view showing mounted states of another bin unit home sensor and another lower abnormality sensor switch.
Figure 4E:
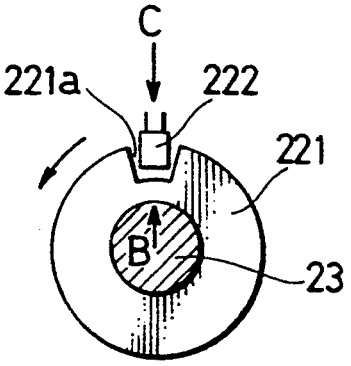
FIG. 4E is a plan view showing a construction of a device for detecting a reference direction of a cylindrical cam.

FIGS. 4B, 4C are diagrams showing a positional relationship of the bin unit home sensor 218 and the lower abnormality sensor switch 219, FIGS. 4B, 4C being plan and front views respectively.

The bin unit home sensor 218 includes, for example, a photointerrupter. A slit-like sensing portion 218*a* is provided on a side face of the sensor main body. In this sensing portion 218*a* is emitted a light used for the sensing. When the bin unit 15 is shifted downward and the sensor plate 217 is fitted in the sensing portion 218*a* to thereby interrupt a light path (FIG. 4C), the bin unit home sensor 218 detects that the bin unit 15 has been lowered to the home position region.

The lower abnormality sensor switch 219 includes a known limit switch having a detection lever 219*a*. The switch 219 is mounted at a specified position near the bin unit home sensor 218 through a mount plate 225. In other words, the switch 219 is mounted such that the detection lever 219*a* crosses a moving path of the sensor plate 217 at a given point P below the bin unit home sensor 218.

The mount plate 225 includes a support plate 251 for supporting the lower abnormality sensor switch 219 and a fixed plate 252 for fixing the mount plate 225 to the sorting unit 14. A leading end 251*a* of the support plate 251 serves as a guide portion for guiding the sensor plate 217 to the sensing portion 218*a* of the bin unit home sensor 218. At upper and lower corner portions of the leading end 251*a* are formed guiding tapers.

Accordingly, the mount plate 225 is fixed to the sorting unit 14 through the fixed plate 252 at a position where the leading end 251*a* of the support plate 251 faces the sensing portion 218*a* of the bin unit home sensor 218. The lower abnormality sensor switch 219 has a side face thereof facing the bin unit home sensor 218 mounted to the support plate 251. A side face of the switch 219 opposite to the side face facing the bin unit home sensor 218 may be mounted to the support plate 251.

The switch 219 is mounted to the support plate 251 with a face 219*b* thereof where the detection lever 219 of the switch main body is provided displaced inwardly away from the leading end 251*a* of the support plate 251 by a specified distance S so that the detection lever 219*a* crosses the specified point P on the moving path of the sensor plate 217.

With the above construction, when the bin unit 15 is lowered to the home position region, the sensor plate 217 is guided to the sensing portion 218*a* of the bin unit home sensor 218 by the leading end 251*a* of the support plate 251 of the mount plate 225, thereby interrupting the optical path in the sensing portion 218*a* reliably. In this way, it is detected that the bin unit 15 has reached the home position region.

If the bin unit 15 is lowered further, the sensor plate 217 comes to contact with the detection lever 219*a* of the lower abnormality sensor switch 219 at the point P. The detection lever 219*a* is in turn rotated toward the switch main body to turn the switch 219 on, thereby detecting the abnormality in the downward moved amount of the bin unit 15.

In this way, the sensor plate 217 provided in the bin unit 15 is guided by the support plate 251 to the position where it is in contact with the sensing portion 218*a* of the bin unit home sensor 218 and to another position where it is in contact with the detection lever 219*a* of the switch 219. Accordingly, even if the moving path of the sensor plate 217 changes due to the shakiness of the bin unit 15 and the deformation of the sensor plate 217, the sensor plate 217 does not collide with and damage the bin unit home sensor 218 or lower abnormality sensor switch 219. Since the contact position of the sensor plate 217 with the detection lever 219*a* is stabilized, the likelihood of an erroneous detection of the abnormality can be reduced. Further, since the support plate 251 is formed integrally with the mount member for the lower abnormality sensor switch 219, the switch 219 can be fabricated in a simple structure at a low cost.

The face of the sensor plate 217 facing the lower abnormality sensor switch 219 is guided by the mount plate 225 in FIGS. 4B, 4C. However, a guide plate 226 may be provided in such a position opposed to the leading end face 251*a* of the support plate 251 of the mount plate 225 and spaced away therefrom by a specified distance. It may be also appropriate to form the guide plate 226 and the support plate 251 integrally.

When the lower and upper abnormality sensor switches 219, 220 are turned on, the driving of the sorter is stopped. Thereupon, for example, in a display unit is displayed a warning indicative of a service person call urging the inspection by a service person.

Referring back to FIG. 4A, at a base portion of the cylindrical cam 23 is provided a rotation angle detector for detecting the rotated amount of the cylindrical cam 23. This detector includes a pulse plate 235 having a plurality of notches spaced apart equally circumferentially and rotatable together with the cylindrical cam 23, and a rotation angle sensor 236 for detecting the notches of the pulse plate 235.

At the base portion of the cam 23 is also provided a reference direction detector for detecting a reference direction in the rotating operation of the cylindrical cam 23. The reference direction detector includes a rotor 221 having a notch 221*a* formed at a specified circumferential position thereof and rotatable together with the cylindrical cam 23, and a cylindrical cam sensor 222 for detecting the notch 221*a* of the rotor 221. This detector detects a reference direction B of the cylindrical cam 23. The cylindrical cam sensor 222 faces in a predetermined direction C so as to detect the notch 221*a* of the rotor 221 when a reference position A defined at a specified position of the lower end portion of the bin unit 15 becomes at the same level with the home position HP.

With the above construction, the bin unit 15 is shifted upward and downward in accordance with a pulse signal given from the rotation angle sensor 236 and a sensor signal given from the cylindrical cam sensor 222.

For example, in the case where the bin unit 15 is elevated by one stage, i.e. the cylindrical cam 23 makes one turn, the pulse number of the pulse signal given from the rotation angle sensor 236 is counted after the start of the rotation. When the cylindrical cam 23 rotates by a specified rotation angle, the rotating speed of the motor 230 is reduced and the driving of the motor 230 is stopped at a position where the reference direction B is detected by the cylindrical cam sensor 222. Thus, the cylindrical cam 23 stops precisely after making one turn.

The downward movement of the bin unit 15 is stopped upon detecting that the bin unit home sensor 218 and the cylindrical cam sensor 222 have been turned on, thereby being lowered to the home position HP accurately.

Figure 16:
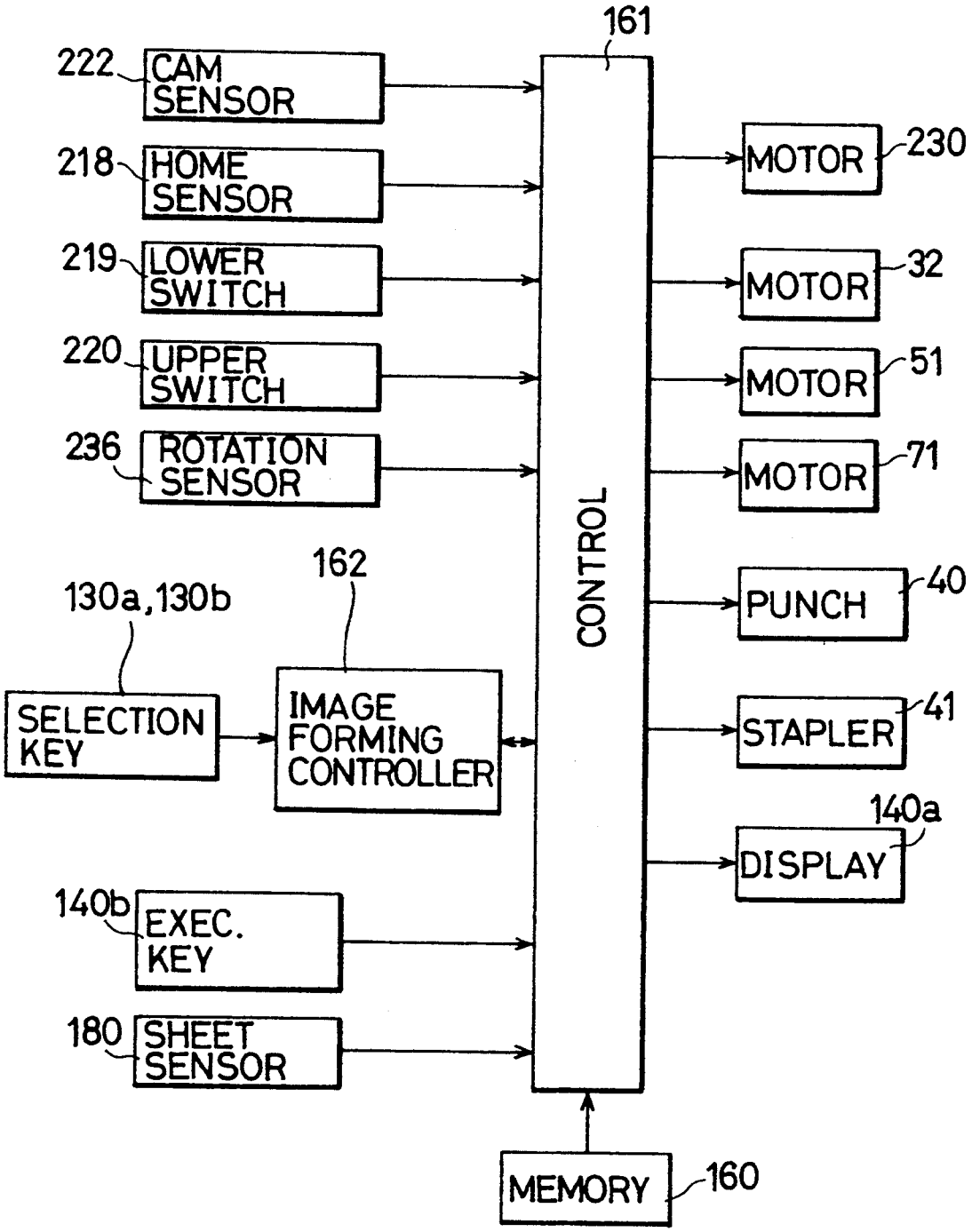
FIG. 16 is a block diagram showing a control system of the image forming apparatus.

There will be described the construction of a control system next with reference to FIG. 16. In this figure, like numerals designate like members shown in FIGS. 1 to 3, and 4A.

This control system includes a memory 160 and a controller 161. The memory 160 includes ROM, RAM, and the like for storing a plurality of types of standardized processing positions such as positions to be stapled and punched and a sorter control program.

The controller 161 controls the operation of the bins 16 in sorting out the copy sheets, and drives the motor 230 in accordance with the sensor signals from the bin unit home sensor 218, the cylindrical cam sensor 222, the lower abnormality sensor switch 2190 and the like so as to rotate the cylindrical cam 23.

Further, the controller 161 is connected with an image forming controller 162 for controlling the optical system and the image forming assembly of the image forming unit 2, and controls the sheet processor 28 such as the punch 40 and the stapler 41 and the motors 32, 51, 71 so as to apply a specified processing in accordance with the detection result of the sheet sensor 180 and the operated contents of the processing execution key 140*b* and the sheet processing selection keys 130*a*, 130*b*. The controller 161 also controls the display of the display unit 140*a* according to the detection result of the sheet sensor 180 and the operated content of the processing execution key 140*b*.

Figure 17:
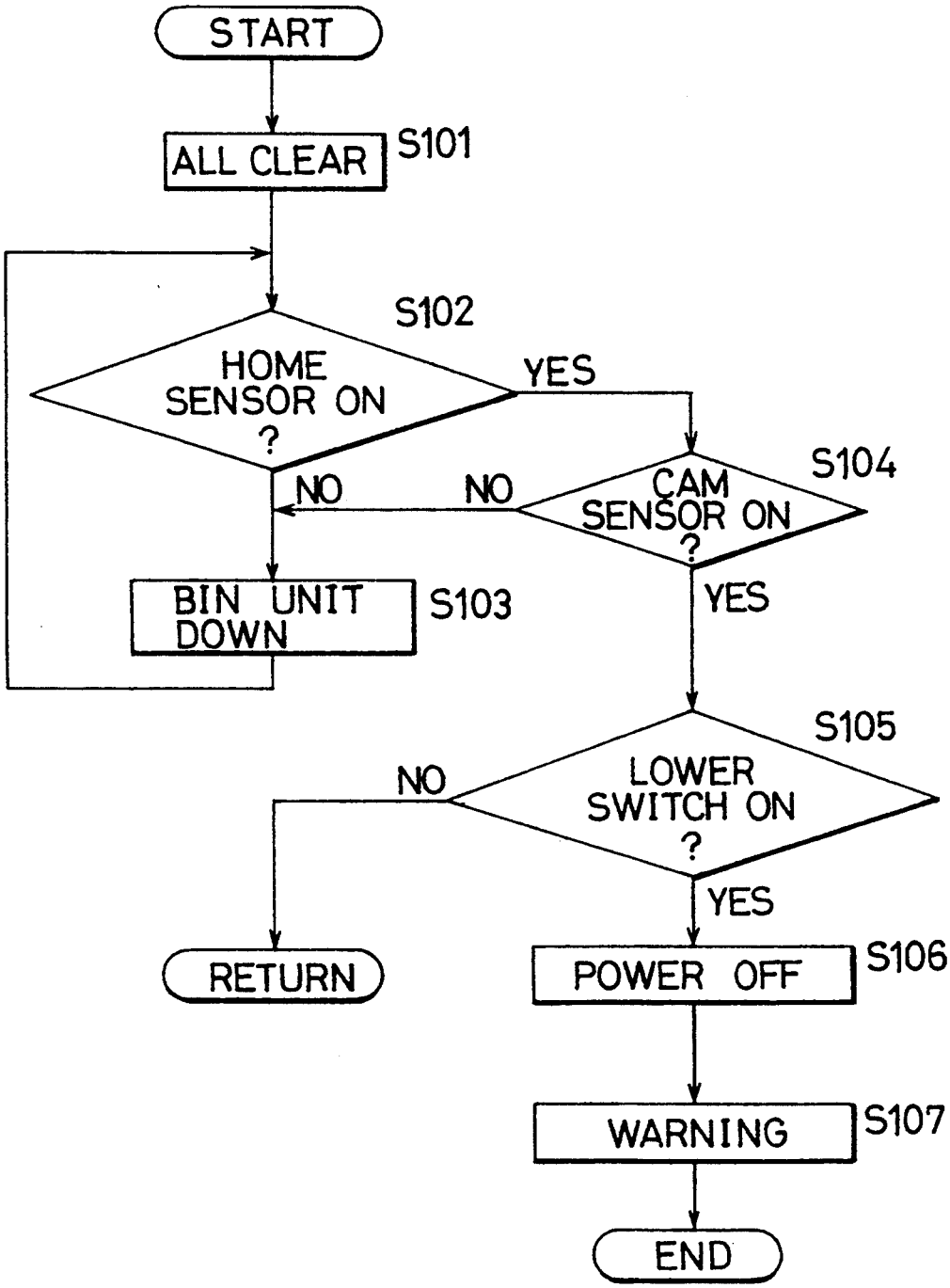
FIG. 17 is a flow chart showing an exemplary initialization operation when the sorting of copy sheets is started.

There will be described an exemplary initialization operation when the sorting of the copy sheets is started with reference to a flow chart shown in FIG. 17.

First of all, it is discriminated whether the bin unit home sensor 218 is on in Step S102 after clearing all the contents of flags, registers, and the like in Step S101. If the sensor 218 is off, the bin unit 15 is moved down until the sensor 218 is turned on (a loop of Steps S103, S102).

When the bin unit 15 is moved down to turn on the sensor 218, it is discriminated whether the cylindrical cam sensor 222 has detected the reference direction B of the cylindrical cam 23 in Step S104. If the reference direction B has not been detected, the bin unit 15 is continued to be moved down until the reference direction B is detected (a loop of Steps S103, S102, S104).

When the reference direction B of the cylindrical cam 23 is detected, there is detected the abnormality in the downward moved amount of the bin unit 15 by the lower abnormality sensor switch 219 in Step S105. If the abnormality is not detected, the bin unit 15 is ready for the sorting operation and this routine returns to a main routine in which the sorting operation is carried out in association with the copying operation. On the other hand, if the abnormality is detected in the downward moved amount, the power supply is turned off in Step S106 and the warning indicative of the service person call is displayed in Step S107.

Figure 18:
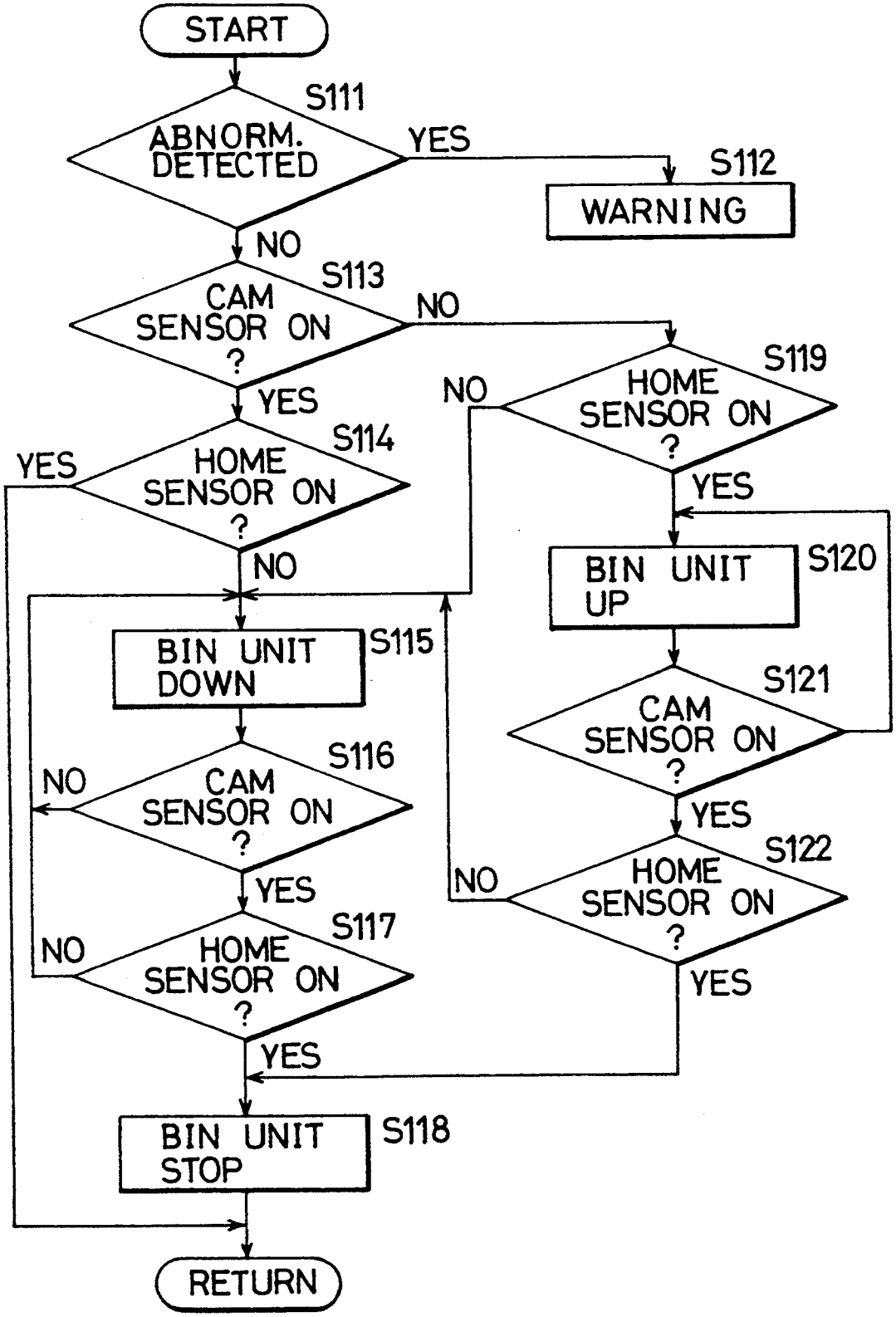
FIG. 18 is a flow chart showing another initialization operation when the sorting of copy sheets is started.

There will be next described another initialization operation when the sorting of copy sheets is started with reference to a flow chart shown in FIG. 18. FIG. 18 is the flow chart showing an initial reset routine of the bin unit 15 when the power is applied to the sorting unit 14. According to this routine, the reference position A of the bin unit 15 is initialized accurately at the home position HP so as to allow the sorting operation to be carried out immediately after the application of the power.

When the power is applied to the sorting unit 14, it is discriminated whether any abnormality is detected in the set position of the bin unit 15 by the lower or upper abnormality sensor switch 219 or 220 in Step S111. If the abnormality is detected, the warning indicative of the service person call is displayed in Step S112.

If no abnormality is detected in the set position of the bin unit 15 (NO in Step S111), it is discriminated whether the notch 221*a* of the rotor 221 has been detected by the cylindrical cam sensor 222, i.e. whether the reference direction B of the cylindrical cam 23 is in agreement with the predetermined direction C, in Step S113. Subsequently, in Step S114, it is discriminated whether the bin unit 15 has been moved down to the home position region by the use of the bin unit home sensor 218.

If the reference direction B is in agreement with the predetermined direction C and the bin unit 15 has been moved down to the home position region (YES in Steps S113, S114), this routine returns to the main routine so as to carry out the sorting operation since the reference position A of the bin unit 15 is at the same level with the home position HP.

On the other hand, if the reference direction B is in agreement with the predetermined direction C but the bin unit 15 has not been moved down to the home position region yet (YES in Step S113, NO in Step S114), the motor 230 is driven to move the bin unit 15 downward in Step S115 since the bin unit 15 is located above the home position HP. The driving of the motor 230 is stopped in Step S117 after the notch 221*a* of the rotor 221 is detected by the cylindrical cam sensor 222 (YES in Step 116) and the bin unit 15 is detected to have been moved down to the home position region (YES in Step S117), and this routine returns to the main routine.

If the reference direction B is at variance with the predetermined direct ion C in Step S113, it is discriminated whether the bin unit 15 has been moved down to the home position region by the use of the bin unit home sensor 218 in Step S119. If the bin unit 15 has not been moved down to the home position region yet (NO in Step S119), this routine proceeds to Steps S115 to S118 in which the bin unit 15 is shifted downward until the bin unit 15 is detected to have been moved down to the home position region by the bin unit home sensor 218 and the cylindrical cam sensor 222 detects the notch 221*a* of the rotor 221. Consequently, this routine returns to the main routine.

On the other hand, if the bin unit 15 is in the home position region in Step S119, the motor 230 is driven to shift the bin unit 15 upward in Step S120 since the reference position A of the bin unit 15 is out of the home position region. When the notch 221*a* of the rotor 221 is detected by the cylindrical cam sensor 222 while the bin unit 15 being shifted upward is in the home position region (YES in Steps S121, S122), the driving or the motor 230 is stopped in Step S118 and this routine returns to the main routine.

If the bin unit 15 is shifted upward and the notch 221*a* of the rotor 221 is detected by the cylindrical cam sensor 222 beyond the home position region (YES in Step S121, NO in Step S122), this routine proceeds to Steps S115 to S118 in which the bin unit 15 is shifted downward until the bin unit 15 is detected to have been moved down to the home position region by the bin unit home sensor 218 and the cylindrical cam sensor 222 detects the notch 221*a* of the rotor 221. Consequently, this routine returns to the main routine.

As described above, in the initialization of the bin unit 15 when the power is applied to the sorting unit 14, the bin unit 15 is shifted downward when located above the home position region. When the bin unit 15 is located in the home position region but is displaced from the home position HP, the bin unit 15 is shifted upward to bring the reference position A of the bin unit 15 to the same level with the home position HP accurately. Accordingly, the bin unit 15 is permitted to be initialized at the home position HP reliably.

Figure 19:
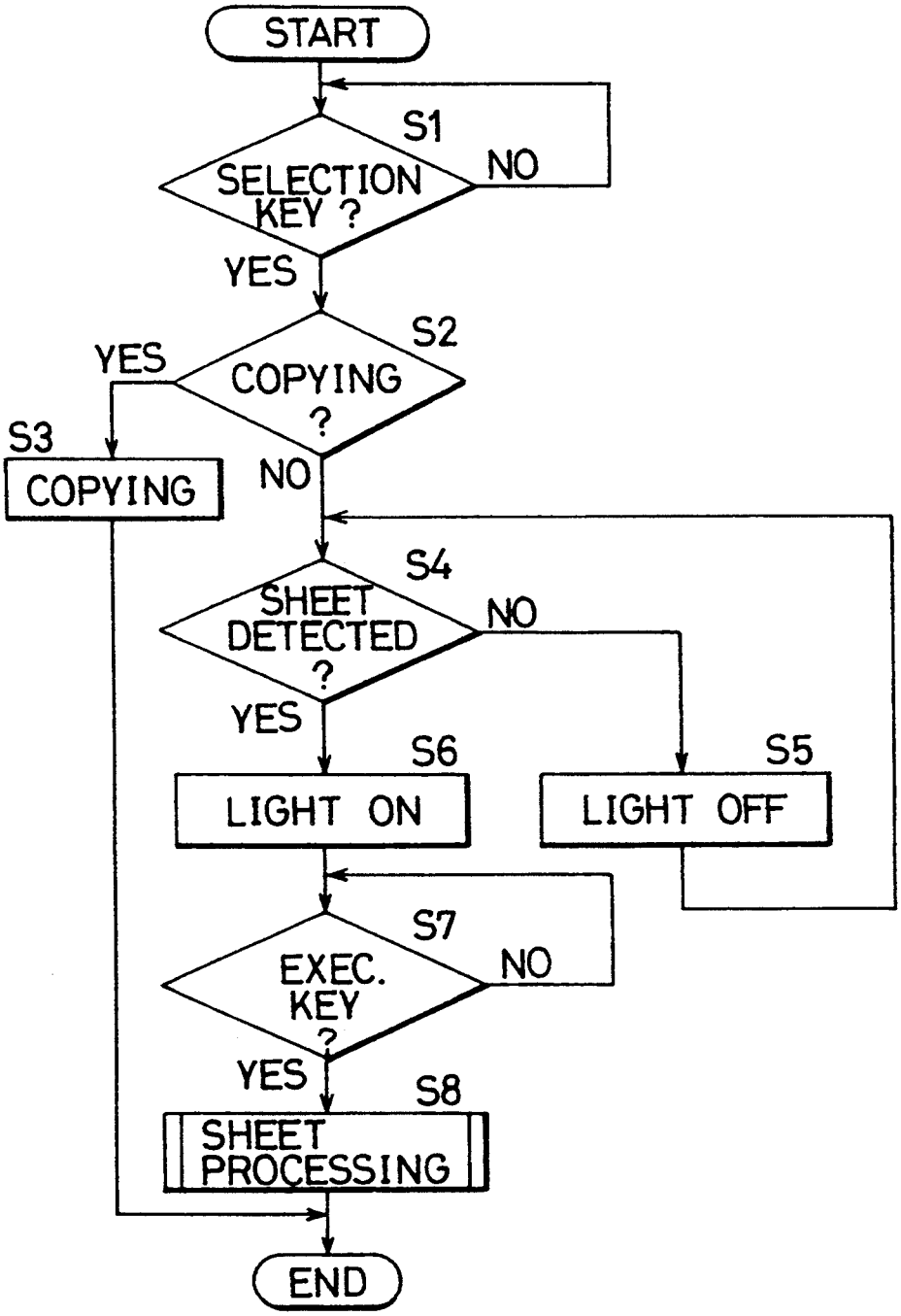
FIG. 19 is a flow chart showing an operation procedure in the case where a sheet processing is applied to a copy sheet on the bin.

There will be described an operation of the controller 161 when the sheet processing is applied to the set of copy sheets placed on the bin 16 next with reference to a flow chart shown in FIG. 19. In the case where only the copying is carried out, the copying and sorting operations are carried out when the copying switch is operated after the number of copies to be made is designated through the operation panel 12.

First of all, it is discriminated whether the sheet processing mode has been selected by manipulating the sheet processing selection keys 130*a*, 130*b* of the image forming unit 2 in Step S1. This routine waits in standby until either one of the sheet processing selection keys 130*a*, 130*b* is operated (NO in Step S1).

If, for example, the punching is selected by manipulating the sheet processing selection key 130*a* or 130*b* (YES in Step S1), the number of copies to be made is designated through the operation panel 12 and it is discriminated whether the copying switch has been operated in Step S2. When the copying switch is operated (YES in Step S2), the document images are transferred by the image forming unit 2 to the copy sheets, which are discharged to the bin unit 15. The discharged sheets are sorted one after another onto the bins 16 in Step S3.

On the other hand, if the copying switch is not operated (NO in Step S2), it is discriminated whether the presence of the sheets which were inserted manually to the bin 16 to be processed has been detected by the sheet sensor 180 in Step S4. If no sheet is set on the bin 16 (NO in Step S4), the display unit 140*a* is lighted off, lighted on and off, or a display indicative of that no sheet is set is made in the display unit 140*a* in Step S5, and this routine returns to Step S4.

On the other hand, if the sheet is set on the bin 16, the sheet is detected by the sheet sensor 180 (YES in Step S4). Then, in Step S6, the display lamp 141*a* or 142*a* is lighted on according to the sheet processing mode selected by the sheet processing selection key 130*a* or 130*b*. In this way, a user is allowed to confirmed the selected sheet processing mode.

Thereafter, it is discriminated whether the processing execution key 140*b* has been operated in Step S7. This routine waits in standby until the processing execution key 140*b* is operated (NO in Step S7). When the processing execution key 140*b* is operated (YES in Step S7), the sheet processing corresponding to the sheet processing mode selected by the sheet processing selection key 130*a* or 130*b*, e.g., the punching, is carried out in Step S8.

In this way, even when the sheets are inserted manually, the user selects the sheet processing mode through the operation panel 130 of the image forming unit 2; confirms the selected sheet processing mode by viewing the display unit 140*a* of the sorting unit 14; and carries out the sheet processing corresponding to the selected sheet processing mode by operating the processing execution key 140*b*. Accordingly, a maloperation can be prevented. Further, since only the processing execution key 140*b* is provided in the sorting unit 14 for the sheet processing, the number of elements constituting the sorting unit 14 can be reduced.

Figure 20:
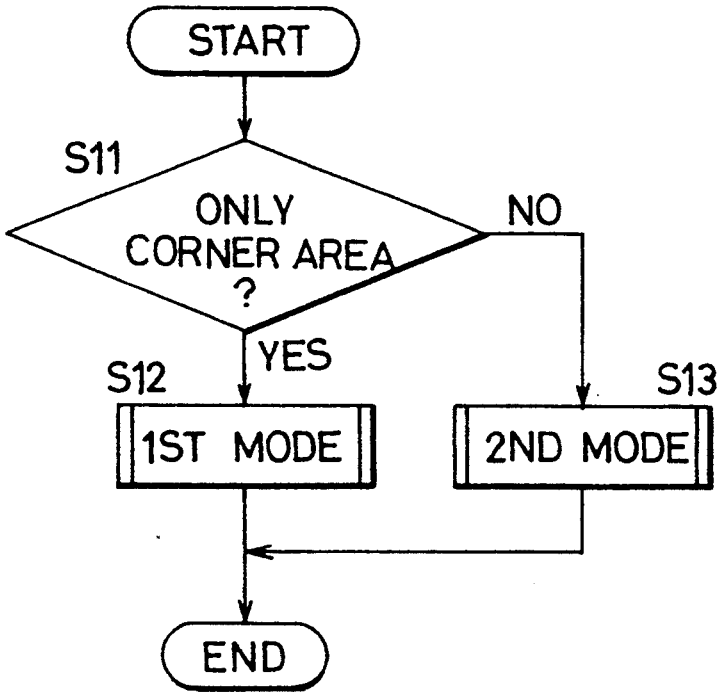
FIG. 20 is a flow chart showing a basic procedure executed in applying the sheet processing.
Figure 21:
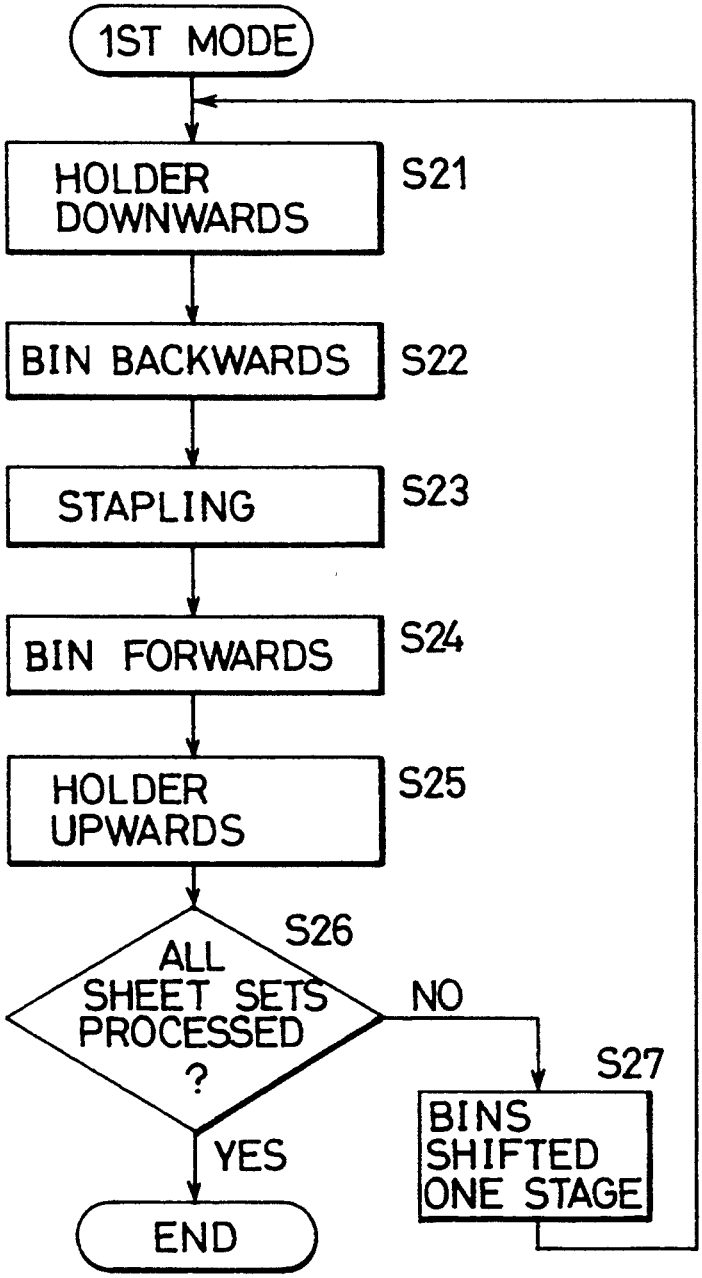
FIG. 21 is a flow chart showing an operation procedure of a first mode, i.e. applying the sheet processing to one corner portion of the sheet.
Figure 22:
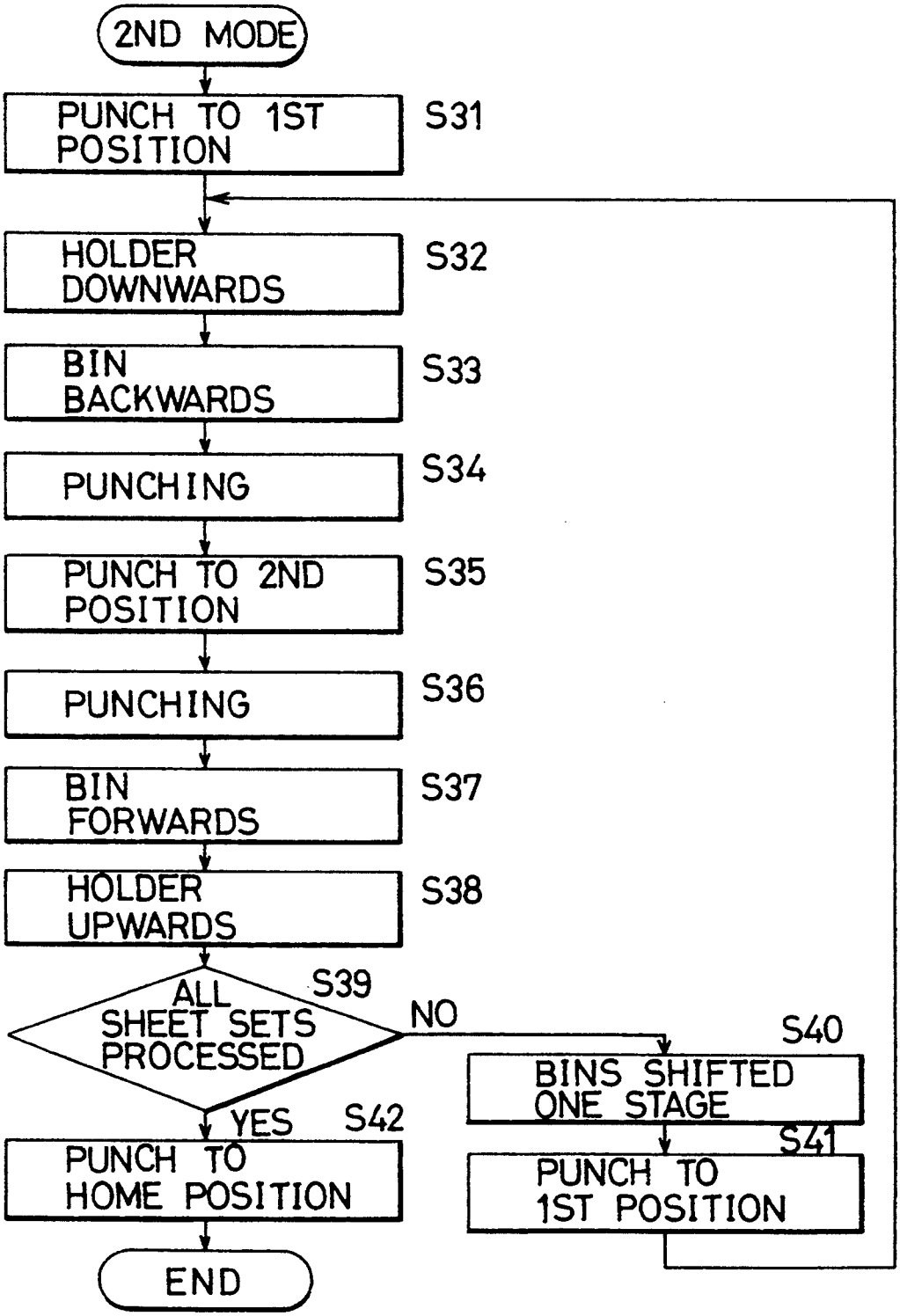
FIG. 22 is a flow chart showing an operation procedure of a second mode, i.e., applying the sheet processing to the sheet at two positions in a widthwise direction of the sheet.

A procedure of applying the sheet processing in Step S8 will be described next with reference to flow charts shown in FIGS. 20 to 22. FIG. 20 is a flow chart showing a basic procedure of applying the sheet processing.

First of all, the position of the sheets where the sheet processing is applied is discriminated in Step S11. If this position is only one corner position where the sheet processor 28 is initially located (YES in Step S11), this routine proceeds to Step S12 so as to carry out the corresponding processing (hereinafter referred to as a first mode).

If the position to be processed is not the one corner position where the sheet processor 28 is initially located or there still remains one or more positions to be processed (NO in Step S11), this routine proceeds to Step S13 so as to carry out the corresponding processing (hereinafter referred to as a second mode).

A procedure of the first mode will be described. FIG. 21 is a flow chart showing an operation procedure when the first mode is carried out, i.e. the sheet processing is applied to the sheets at one corner position. In this case, the stapling is applied to the sheets at one corner position.

Figure 12:
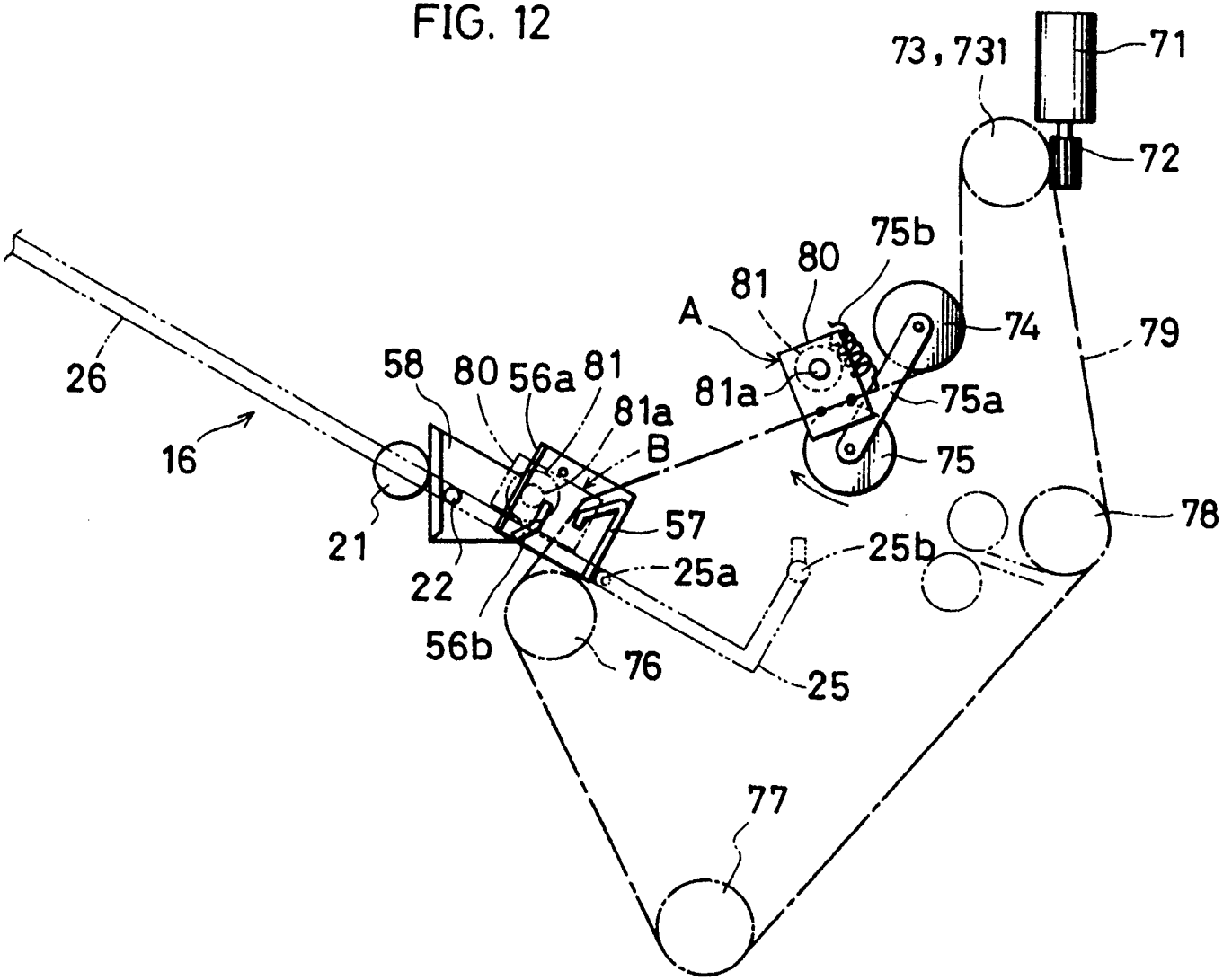
FIG. 12 is a schematic side view showing a holder moving mechanism.

Before the bin 16 starts being retracted, the sheet holder 81 waits in standby in a position vertically away from the bin 16 by a specified distance as indicated by solid line A in FIG. 12. The cylindrical cams 23 rotate and stop at a specified angle position to thereby shift the bin 16 bearing the sheets to which the stapling is applied upward or downward to the operative position. Then, the motor 71 is driven to move the sheet holder 81 toward the bin 16, and the shaft 81*a* of the sheet holder 81 is fitted between the fitting members 56*a* and 56*b* of the operable members 58 as indicated by phantom line B in FIG. 12. As a result, the sheet holder 81 comes to contact with the copy sheets placed on the bin 16 in Step S21 and becomes movable integrally with the bin 16.

The motor 71 is stopped in this fitting state and the motor 51 is in turn driven to thereby start rotating the worm wheels 53*a* and sprockets 53*b* through the worm 52. Then, the chains 55 rotate counterclockwise in the drawing of FIGS. 11A. According to the rotation of the chains 55, the operable members 58 start being retracted along the guide rails 60. At this time, the operable members 58 push the third pins 22 and accordingly the bin 16 is retracted according to the movement of the operable members 58 in a state where the shaft 81*a* is fitted between the fitting members 56*a* and 56*b* in Step S22.

During this retraction, the shaft 81*a* of the sheet holder 81 comes to contact with the front end portion 33*b* of the biasing member 33. When the bin 16 is further retracted, the shaft 81*a* is guided to the lower surface 33*c* along the tapered portion. At this time, the sheet holder 81 is biased downward by the biasing member 33 to press and fix the copy sheets on the bin 16.

On the other hand, the stopper 25 is released when the refraining member 27 rotates because of the releasing member 8 and the releasing piece 27*b* coming to contact with each other while the bin 16 is being retracted. At this stage, the rollers 25*b* of the stopper 25 are fitted in the openings 18*a* of the guide rails 18. The rollers 25*b* move downward along the guide rails 18 according to the further retraction of the bin 16. Thus, the stopper 25 rotates downward, thereby opening up the rear end portion of the bin 16. As the stopper 25 rotates, the front end of the projected portion 250 comes to contact with the underside of the planar portion 26 of the bin 16. In this state, the restricting member 19 comes to sliding contact with the underside of the planar portion 26. The motor 51 is stopped when the copy sheets P on the bin 16 come to a position where they are set in the stapler 41, and the stapling is applied to the copy sheets P in Step S23. In this way, the rigidity of the bin 16 becomes smaller by the rotation of the stopper 25 and the bin 16 becomes liable to warp upon being subjected to a pressing force given from the sheet holder 81. However, at this time, since the projected portion 250 comes to contact with the underside of the planar portion 26 of the bin 16, the warping of the bin 16 is prevented. Accordingly, the copy sheets P on the bin 16 can be set in the stapler 41 properly. Further, since the warp preventing member 19 comes to sliding contact with the underside of the planar portion 26 in this state, the warping of the bin can be prevented reliably during the stapling operation.

After the completion of the stapling operation, the motor 51 is driven in a reverse direction to rotate the chains 55 clockwise and to move the operable members 58 forward along the guide rails 60. By this movement of the operable members 58, the bin 16 moves forward in Step S24.

According to the forward movement of the bin 16, the rollers 25*b* move upward along the guide rails 18 and the stopper 25 rotates upward. When the stopper 25 returns to its original position, the releasing member 8 is disengaged from the refraining member 27, which in turn act to hold the stopper 25 in the original position. Subsequently, the motor 51 is stopped after the second pins 21 of the bin 16 return to the groove 24 of the cylindrical cam 23. Thereafter, the motor 71 is driven to move the sheet holder 81 away from the bin 16 in Step S25.

In Step S26, it is discriminated whether the stapling has been applied to all the bins 16 bearing the sheets thereon. If there still remains the bin 16 bearing the sheets to be stapled (NO in Step S26), a stack of bins 16 are shifted only one stage in Step S27. If the stapling is started from the bottommost bin 16, the stack of bins 16 are shifted downward stage by stage. Conversely, the stack of bins are shifted upward stage by stage if the stapling is started from the uppermost bin 16. The operations of Steps S21 to S27 are carried out for the bin newly set in the operative position. On the other hand, if the stapling has been applied to all the necessary bins 16 (YES in Step S26), the first mode ends.

Here, the first mode is described with respect to the case where the stapling is applied, but the similar control can be also executed when the punching is applied as a sheet processing.

There will be next described a procedure of the second mode. FIG. 22 is a flow chart showing an operation procedure when the second mode is carried out, e.g. the sheet processing is applied to the rear end of the sheets at two positions spaced apart in the widthwise direction.

First of all, the punch 40 is moved in the widthwise direction from a home position thereof, and is caused to stop at a position facing a first punching position in Step S31. Then, similar to the aforementioned Steps S21 and S22, the sheet holder 81 is moved downward until coming to contact with the sheets on the bin 16 in Step S32, and becomes movable integrally with the bin 16. While the bin 16 is being retracted (Step S33), the sheet holder 81 is biased toward the bin 16 by the biasing member 33 so as to press and fix the sheets on the bin 16 and the stopper 25 is released to set the sheets in the punch 40. The punch 40 is actuated to make holes in the sheets in Step S34.

Upon the completion of the punching to the first punching position, the punch 40 is moved further in the same direction and is caused to stop at a position facing the second punching position in Step S35. Then, the punch 40 is actuated to make holes in the sheets in Step S36. Upon the completion of the punching, the bin 16 is moved forward in Step S37 similar to the aforementioned Steps S24 and S25. While the bin 16 is being moved forward, the stopper 25 is returned to its original position and held thereat by the refraining member 27. After the bin 16 returns to the original position, the sheet holder 81 is moved upwards from the bin 16 in Step S38.

In Step S39, it is discriminated whether the punching has been applied to all the bins 16 bearing the sheets thereon. If there still remains the bin 16 bearing the sheets to be punched (NO in Step S39), the stack of bins 16 are shifted only one stage in Step S40. If the punching is started from the bottommost bin 16, the stack of bins 16 are shifted downward stage by stage. Conversely, the stack of bins are shifted upward stage by stage if the punching is started from the uppermost bin 16.

Subsequently, the punch 40 is moved in the widthwise direction toward the home position and is caused to stop at the position facing the first punching position in Step S41, the operations of Steps S32 to S41 are repeated for the bin 16 newly set in the operative position.

On the other hand, if the punching has been applied to all the necessary bins 16 (YES in Step S39), the punch 40 is returned to the home position in Step S42 and the second mode end.

Here, the second mode is described with respect to the case where the punching is applied, but a similar control can be also executed when the stapling is applied. Further, a similar control can be executed even when a plurality of types of sheet processing such as the punching and the stapling are applied to the sheets placed on the bin 16.

Although the above example is described with respect to the control executed when the sheet processing is applied at two positions, a similar control can be executed when the sheet processing is applied at three or more positions and the sheet processing can be applied at arbitrarily set positions.

The foregoing embodiment is described with respect to the case where the punch 40 and the stapler 41 are used as a sheet processor 28. However, the sheet processor 28 is not limited to these devices, but may be a printer or any other device provided that it is capable of applying a processing to sheets.

The sheet holder 81 presses and fixes the sheets on the bin 16 by being biased by the biasing member 33 while the bin 16 is being retracting in this embodiment. However, it may be appropriate to hold the sheet holder 81 above the bin 16 while the bin 16 is being retracted and to move the same toward the bin 16 after the retraction of the bin 16 is completed to press and fix the sheets on the bin 16. Alternatively, the sheet holder 81 may be biased by the biasing member 33 to press and fix the sheets on the bin 16 when the retraction of the bin 16 is started.

Further, the sheet holder 81 may be biased by a biasing means provided at the bin 16.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A sorter for sorting sheets comprising:

a bin unit including a plurality of bins having a specified length and width, said bins being vertically spaced apart and being adapted for placing the sorted sheets thereon;

a shifting means for shifting the bin unit upward and downward;

a projected member provided at the bin unit;

a first detector means for detecting that the bin unit has been moved down to a home position by detecting the presence of the projected member;

a second detector means including a detection lever provided projectingly below the first detector means in such a position as to cross the moving path of the projected member and adapted for detecting that the bin unit has reached a lower limit position when the projected member comes into contact with the detection lever; and a common guide means for guiding the projected member to the first detector means and to the contact position with the detection lever of the second detection means.

2. A sorter according to claim 1 wherein the projected member includes a planar portion, wherein the first detector means includes a slit-like sensing portion and detects that the bin unit has been moved down to the home position when the planar portion of the projected member is fitted in the sensing portion, and wherein the guide means guides the projected member to contact positions with a sensing portion of the first detector means and with a detection lever of the second detector means.

3. A sorter according to claim 1 wherein the guide means is formed integrally with a mount member for mounting the second detector means on the sorter.

4. A sorter for sorting sheets comprising:

a bin unit including a plurality of bins having a specified length and width, said bins being vertically spaced apart and being adapted for placing the sorted sheets thereon, each of said bins including at a rear end portion thereof a stopper for aligning a trailing edge of the sheet, the stopper being rotatable so as to open up the rear end portion of the bin;

a rotating means for rotating the stopper;

a sheet processing means provided behind the bins with respect to a lengthwise direction thereof and adapted for applying a specified processing to the sheet placed on the bin, the sheet processing means applying the processing to a portion of the sheet which is exposed when the stopper is rotated to thereby open up the rear end portion of the bin;

a moving means for moving the bin forward and backward so as to move the bin close to and away from the sheet processing means; and a shifting means for shifting the bin unit upward and downward.

5. A sorter according to claim 4 further comprising:

a pressing means provided above the bin excluding the rear end portion movably upward and downward and adapted for pressing the sheet placed on the bin against the bin; and a biasing means for bringing the sheet pressing means into pressing contact with the sheet placed on the bin before the rear end portion of the bin is opened up.

6. A shorter according to claim 5 wherein the biasing means brings the pressing means into pressing contact with the sheet placed on the bin before the rear end portion of the bin is opened up and as the bin moves closer to the sheet processing means.

7. A sorter according to claim 5 wherein the pressing means is formed movably integrally with the bin.

8. A sorter according to claim 5 wherein the biasing means generates a pressing force according to the movement of the bin toward the sheet processing means.

9. A sorter according to claim 4 further comprising a drive means for driving the rotating means according to the movement of the bin toward the sheet processing means.

10. A sorter according to claim 9 wherein the drive means includes a guide member for guiding the rotation of the stopper, the guide member being positioned such that the drive means operates while the guide member is guiding the rotation of the stopper.

11. A sorter according to claim 9 wherein the drive means includes a guide member for guiding the rotation of the stopper, the guide member being formed such that a rotated amount of the stopper corresponds to a moved amount of the bin toward the sheet processing means.

12. A sorter according to claim 4 further comprising:

a pressing means for pressing the bin excluding the rear end portion at a specified position to fix the sheet placed on the bin; and a warp preventing member which comes into contact with the position of the bin excluding the rear end portion when the bin has moved toward the sheet processing means so as to prevent the bin from warping.

13. A sorter according to claim 12 wherein the warp preventing member includes a recessed portion formed at a widthwise center of the stopper and extending in a forward direction, the recessed portion being formed so as to come into contact with the underside of the bin when the rear end portion of the bin is opened up by the rotation of the stopper.

14. A sorter according to claim 12 wherein the warp preventing member is fixed to the sorter in such a position that a leading end thereof comes to contact with the underside of the bin excluding the rear end portion when the bin moves toward the sheet processing means.

15. The combination comprising:

(a) a sorter comprising:

(i) a bin unit including a plurality of bins vertically spaced apart for placing sorted sheets thereon;

(ii) shifting means for shifting the bin unit upward and downward;

(iii) sheet processing means for applying at least two types of sheet processing to sheets placed on the bin unit;

(b) an image forming apparatus comprising manually operable selecting key means for selecting a desired type of sheet processing for sheets placed on the bin of said sorter;

(c) connecting means for connecting said sorter to said image forming apparatus;

(d) said sorter further comprising control means responsive to said selecting key means for controlling said sheet processing means to execute the selected type of sheet processing, said control means including manually operable execution key means on said sorter operable to initiate the selected sheet processing selected by said selecting key means on said image forming apparatus.

16. A sorter according to claim 15 wherein said control means further comprises a display means on said sorter for displaying the type of sheet processing selected by said selecting key means on said image forming apparatus.

17. A sorter according to claim 15 wherein said sheet processing means is operable independently of the copying operation of the image forming apparatus.

18. A sorter accordingly to claim 15 wherein the sheet processing means comprises a punch for applying punching to the sheet.

19. A sorter according to claim 15 wherein the sheet processing means comprises a stapler for applying stapling to the sheet.

20. The combination comprising:

(a) a sorter comprising:

(i) a bin unit including a plurality of bins vertically spaced apart for placing sorted sheets thereon;

(ii) shifting means for shifting the bin unit upward and downward;

(iii) sheet processing means for applying at least two types of sheet processing to sheets placed on the bin unit while said sheets are maintained stationary in the bin unit;

(b) an image forming apparatus comprising manually operable selecting key means for selecting a desired type of sheet processing for sheets placed on the bin of said sorter;

(c) connecting means for connecting said sorter to said image forming apparatus;

(d) said sorter further comprising control means responsive to said selective means for controlling said sheet processing means to execute the selected type of sheet processing, said control means including display means on said sorter for displaying to an operator the type of sheet processing selected by said selecting key means on said image forming apparatus, said control means further comprising manually operable execution key means on said sorter operable to initiate the selected sheet processing selected by said selecting key means.

21. A sorter for sorting sheets comprising:

a bin unit including a plurality of bins for receiving sorted sheets;

rotatable shifting means operable to shift said bin unit upward and downward;

said bin unit being shiftable by said rotatable shifting means to a home position region;

first detector means for detecting that said bin unit has moved to said home position region;

second detector means for detecting a reference rotational position of said rotatable shifting means; and shift control means operable to control said rotatable shifting means to effect movement of said bin unit to said home position region as detected by said first detector means, said shift control means further being operable to control rotation of said rotatable shifting means to rotate said rotatable shifting means to said reference rotational position as detected by said second detector means to thereby accurately position said bin unit at a home position.

22. A sorter according to claim 21 wherein said second detector means comprises a rotor driven by said rotatable shifting means and a fixed sensor means operable to detect the rotatable position of said rotor.

* * * * *